US009598798B2

(12) United States Patent
Potluri et al.

(10) Patent No.: US 9,598,798 B2
(45) Date of Patent: Mar. 21, 2017

(54) METHOD AND APPARATUS FOR WEAVING A THREE-DIMENSIONAL FABRIC

(71) Applicant: The University of Manchester, Manchester, Greater Manchester (GB)

(72) Inventors: Prasad Potluri, Manchester (GB); Dhavalsinh Jetavat, Manchester (GB); Sandeep Sharma, Manchester (GB)

(73) Assignee: THE UNIVERSTIY OF MANCHESTER, Greater Manchester (GB)

( * ) Notice: Subject to any disclaimer, the term of this patent is extended or adjusted under 35 U.S.C. 154(b) by 0 days.

(21) Appl. No.: 14/404,278

(22) PCT Filed: May 30, 2013

(86) PCT No.: PCT/GB2013/051432

§ 371 (c)(1),
(2) Date: Nov. 26, 2014

(87) PCT Pub. No.: WO2013/179037

PCT Pub. Date: Dec. 5, 2013

(65) Prior Publication Data

US 2015/0107715 A1 Apr. 23, 2015

Related U.S. Application Data

(60) Provisional application No. 61/653,066, filed on May 30, 2012.

(30) Foreign Application Priority Data

May 30, 2012 (GB) ..... 1209602.0

(51) Int. Cl.
*D03D 13/00* (2006.01)
*D03D 25/00* (2006.01)
(Continued)

(52) U.S. Cl.
CPC ..... *D03D 25/005* (2013.01); *D03C 9/02* (2013.01); *D03D 11/00* (2013.01); *D03D 41/004* (2013.01);
(Continued)

(58) Field of Classification Search
CPC .... D03D 11/00; D03D 25/005; D03D 13/004; D03D 41/004; D03D 15/00;
(Continued)

(56) References Cited

U.S. PATENT DOCUMENTS 4,922,969 A * 5/1990 Campman ..... D03D 11/00 139/408
5,085,252 A * 2/1992 Mohamed ..... D03D 41/004 139/11
(Continued)

FOREIGN PATENT DOCUMENTS

EP 0 435 205 A1 12/1990
EP 2 347 889 A1 7/2011
WO 02/07961 A1 1/2002

*Primary Examiner* — Bobby Muromoto, Jr.
(74) *Attorney, Agent, or Firm* — Seed IP Law Group LLP

(57) ABSTRACT

A method and apparatus for weaving a three-dimensional fabric involves inserting simultaneously a parallel weft yarns into the sheds between multiple warp yarn layers and selectively inserting at least one group of binder yarns between parallel spaced warp yarns. The group of binder yarns are moved relative to the warp yarns between weft insertions. The yarns may be moved between more than two positions relative to the warp yarns during weaving of the fabric so as to insert binder yarns. In one embodiment the binder yarns are moved such that they extend in a direction that is not orthogonal to the warp yarns.

15 Claims, 15 Drawing Sheets

(51) Int. Cl.
*D03C 9/02* (2006.01)
*D03D 11/00* (2006.01)
*D03D 41/00* (2006.01)

(52) U.S. Cl.
CPC ..... *D10B 2101/06* (2013.01); *D10B 2101/12* (2013.01); *D10B 2331/021* (2013.01); *D10B 2505/02* (2013.01)

(58) Field of Classification Search
CPC .. D03D 1/0052; B29C 70/24; D10B 2505/02; D10B 2101/12; D10B 2331/021; D10B 2331/04; Y10S 139/01; Y10S 428/902; Y10S 428/911; Y10T 442/3195; Y10T 442/3211; D03C 7/00
See application file for complete search history.

(56) References Cited

U.S. PATENT DOCUMENTS 5,217,048 A * 6/1993 Takano ..... D03C 7/00 139/409
5,924,459 A * 7/1999 Evans ..... D03D 25/005 139/11

* cited by examiner

METHOD AND APPARATUS FOR WEAVING A THREE-DIMENSIONAL FABRIC

FIELD OF INVENTION

The present invention relates to apparatus and methods for the manufacture of a three dimensional woven fabric.

BACKGROUND

Three dimensional woven fabrics have application in fibre-reinforced composite materials that are increasingly used as structural and other components in various industries such as, for instance, aerospace, automotive and construction. Such materials comprise a matrix of a suitable polymer such as, for example, epoxy that is reinforced with woven fibres such as, for example, carbon, glass, aramid or Kevlar. Their popularity is attributable to their light weight, high strength, thermal resistance, and ability to be formed into different shapes. Global sales of carbon fibre reinforced plastics, in particular, are forecast to increase dramatically in the next few years.

A three dimensional woven fabric typically comprises multiple layers of warp and weft yarns and vertical binder yarns for binding the layers together. One of the first examples of the manufacture of such fabrics was disclosed in U.S. Pat. No. 3,818,951 (Greenwood). The warp yarns are arranged vertical layers (each layer comprising a horizontal array of warp yarns) to provide the fabric thickness, adjacent layers being separated (shedded) in sequence for the insertion of a weft yarn. The shedding process is repeated down the layers until all the warp yarns are interspersed in the vertical direction with a corresponding weft yarn. A vertical binder yarn is inserted using a heald frame after each group of weft yarns has been inserted. This process is slow and the repeated shedding action causes damage and strain to the fibres. The method is therefore only suitable for a modest number of layers.

U.S. Pat. No. 3,834,424 (Fukuta) describes a method and apparatus for manufacturing a three dimensional fabric in which multiple weft yarns are simultaneously inserted into the sheds defined between the layers of warp. A stack of vertically spaced picking plates move from one side of the fabric to the other where the weft yarns are secured by a selvage yarns and vertical yarns are inserted from below and above. The plates then return to their original position. All three yarns are mutually orthogonal and are woven to create a rectangular or square block of fabric. The method does not allow for variations in fabric thickness and therefore does not provide for woven structures having differing cross-sections.

U.S. Pat. No. 5,085,252 (Mohamed et al.) discloses a method for three dimensional weaving that allows for the production of fabrics with non-rectangular cross-sections. It uses differential weft insertion from both sides. This allows for different lengths of weft insertion from one or both sides and therefore for woven structures having varying cross-sections. Heald frames are used to insert vertical binder yarns. The warp, weft and binder yarns are mutually orthogonal.

There is a continuing demand in the composite materials industry for three dimensional woven fabrics with stronger structural forms and more complex shapes but they must be produced in a cost-effective manner and with limited damage to the fibres. More complex woven fabric shapes are typically produced by joining together separate performs but this is undesirable as it adds another step to the manufacturing process and introduces weaknesses in the integrity and strength of the finished product. Many looms for producing three dimensional woven fabrics are complex. This renders them expensive and difficult to install, operate and maintain.

Three dimensional woven preforms are currently produced on conventional (single weft insertion) weaving machines equipped with a dobby or Jacquard shedding mechanism. These machines can perform a variety of weave styles including orthogonal, angle interlocked, layer-to-layer. These machines are however limited in their function as they a) require repeated movement of all the warp tows resulting in fibre damage; b) are limited in terms of the number of fabric layers that can be encompassed and hence are limited in terms of the thickness of the preform that can be produced; and c) one pick is inserted at a time and hence manufacturing is slow. Thus, methods of preparing three dimensional woven preforms using such machines is not ideal.

Multi-insertion three dimensional weaving processes on the other hand have the advantage of faster production due to multiple weft insertion, most of the warp (stuffer) yarns do not move and they can produce thicker preforms. However, only orthogonal weave is produced on conventional three dimensional weaving machines.

It is one object of the present invention to obviate or mitigate the aforesaid disadvantages.

It is an alternative object of the present invention to provide for an improved or alternative three dimensional woven fabric.

DESCRIPTION OF INVENTION

At its most general, the present invention proposes that the transit of a group of binder yarns through the warp yarn layers does not always occur, as in conventional processes, in a single "inter-weft insertion" step resulting in movement between only the lowest and uppermost positions relative to the warp yarns (i.e. through all of the yarn layers in one step). Instead, in the processes of the present invention the movement of the binder yarns is characterised in that, in at least one "inter-weft insertion" step, the binder yarns pass through only some of the warp yarn layers. Thus the present invention proposes that the binder yarns may move between more than two positions relative to the warp yarns during weaving of the fabric.

In an aspect, the invention provides a method for producing a three dimensional woven fabric comprising the steps of:

- providing a plurality of layers of warp yarns under tension, each layer comprising a plurality of parallel spaced yarns and separating the layers of warp yarns so as to define a shed between each layer;
- selectively inserting simultaneously a plurality of parallel weft yarns a predetermined distance into the sheds between the warp yarns;
- selectively positioning at least one group of binder yarns between parallel spaced yarns of the warp yarn layers; and
- selectively moving the group of binder yarns through only some of the warp yarn layers between weft insertions.

In the above aspect, the binder yarns are moved through only some of the warp yarn layers. In this context, "only some" refers to one or more, but not all. Thus, in the above method, the binder yarns are moved through one or more warp yarn layers, but not through all warp yarn layers, between weft insertions. In embodiments, the group of binder yarns is selectively moved through less than half of the warp yarn layers between weft insertions. In alternative embodiments, the group of binder yarns is moved though at least half or, suitably, more than half of the warp yarn layers between weft insertions. For instance, in embodiments the group of binder yarns is moved through substantially all of the warp yarn layers such as through up to 95%, 90%, 85% or 80% of warp yarn layers between weft insertions. In other words, if twenty warp yarn layers were provided, the group of binder yarns may be moved through up to 19, 18, 17 layers or 16 warp yarn layers between weft insertions. In a preferred embodiment, the group of binder yarns is moved through only one, two, three, four or five, but not through all of the warp yarn layers between weft insertions, suitably wherein the group of binder yarns is moved through only one, two, three or four, but not through all of the warp yarn layers between weft insertions, preferably, only one, two or three, but not all warp yarn layers between weft insertions and more preferably one or two but not all warp yarn layers between weft insertions and typically only one of the warp yarn layers between weft insertions. For instance, for an integer n of warp yarn layers, the binder yarns move through up to n−1 warp yarn layers, for instance up to n−2, n−3, n−4, n−5, n−6, n−7, n−8, n−9 or n−10. In embodiments, for an integer n of warp yarn layers, the binder yarns move through up to n/2 warp yarn layers, for instance through up to n/3, n/4, n/5, n/6, n/7, n/8, n/9 or n/10 warp yarn layers.

Thus, in the above methods, the group of binder yarns may be moved between two or more positions relative to the warp yarn layers during weaving of the fabric. In embodiments, the method comprises moving the group of binder yarns between more than two positions relative to the warp yarn layers during weaving of the fabric. For example, in a first step, moving between first and second positions between weft insertions such that the binder yarns pass through some but not all of the warp yarn layers and, after a weft insertion, in a second step moving the group of binder yarns from the second position to a third position. The first and third positions can for example be the top and bottom of the fabric, such that the binder yarns pass through all of the yarn layers, but the transit of the binder yarns through all of the warp yarn layers does not occur in a single step between weft insertions (but instead by way of two discrete "inter-weft insertion" steps). Alternatively, the first step can for example be to pass the binder yarns through all of the yarn layers and the second step to pass the binder yarns through only some of the warp yarn layers.

Indeed, in embodiments, the method may comprise an additional step of moving the group of binder yarns through all of the warp yarn layers between weft insertions, provided that the method of making the three dimensional fabric includes the step of moving the group of binder yarns between only some of the warp yarn layers between weft insertions. Thus, the method may include steps corresponding to conventional processes.

According to an aspect of the present invention there is provided a method for producing a three dimensional woven fabric comprising the steps of:

providing a plurality of layers of warp yarns under tension, each layer comprising a plurality of parallel spaced yarns, and separating the layers of warp yarns so as to define a shed between each layer;

selectively inserting simultaneously a plurality of parallel weft yarns a predetermined distance into the sheds between the layers of warp yarns;

positioning at least one group of binder yarns between parallel spaced yarns of the warp yarn layers; and selectively moving the group of binder yarns relative to the warp yarns between weft insertions, the group of binder yarns being moved between more than two positions relative to the warp yarns during weaving of the fabric.

Advantageously, the methods of the above aspects and embodiments allow for the production of a variety of binder arrangements and are particularly well adapted to provide angle interlock, layer-to-layer and other similar weave styles. By moving the group of binder yarns through only some of the warp yarn layers, the present methods provide a way to access components having improved fabric strength as a result of the variety of vertical binder yarn arrangements that may be produced, such as interlocking arrangements. The methods of the present invention thus have all of the advantages associated with a conventional multi-insertion weaving system, plus the present processes can produce a variety of other weave styles previously obtainable only with conventional "single weft insertion" machines, including angle interlock, layer-to-layer and other weave styles. In particular, such interlocking binder arrangements are typically not accessible using conventional methods wherein the binder yarns are passed through the all of the warp yarn layers (i.e. orthogonally) at once between weft insertions.

The movement of the group of binder yarns in this manner allows them to be inserted in such a manner that they extend in the woven fabric progressively through the layers, from the uppermost to the lowest, occupying different positions relative to the warp yarn layers between each weft insertion.

Thus, in embodiments, the group of binder yarns are moved between more than two positions relative to the warp yarn layers during weaving of the fabric.

In embodiments, the group of binder yarns are moved in such a manner that they extend in the woven fabric progressively through multiple yarn layers, occupying different positions relative to the warp yarn layers during weaving of the fabric.

In embodiments, the group of binder yarns are moved in such a manner that they extend in the woven fabric progressively through multiple yarn layers, occupying different positions relative to the warp yarn layers between each weft insertion.

In embodiments, the group of binder yarns are moved between in such a manner that they extend in the woven fabric progressively through multiple yarn layers, occupying different positions relative to the warp yarn layers between each weft insertion. That is, the group of binder yarns is moved from a first position relative to the warp yarn layers, through one or more of the warp yarn layers to a second position between each weft insertion during the process.

In embodiments, the group of binder yarns may extend through the woven fabric without extending across all the layers of the warp yarns between insertions of weft yarns.

In one embodiment the group of binder yarns may extend through the woven fabric in a series of orthogonal steps, without extending across all the layers of the warp yarns between successive insertions of weft yarns. For example the binder yarns may progress in a first direction that is orthogonal to the warp and weft yarns and, after insertion of the weft yarns, may extend in a second direction that is perpendicular to the first direction and parallel to the direction of the warp yarns.

The warp yarn layers are held in the separated (shed) position throughout the weaving process. This reduces wear in the yarns.

After each weft insertion and binder yarn movement, the weft yarns are beat up in the conventional manner by, for example, a reed.

In one embodiment the group of binder yarns may extend in a direction that is not orthogonal to the warp yarns. For example, the yarns may extend in a direction that is at an acute to the plane of each layer, rather than passing perpendicularly to the warp yarns between the uppermost and lowest layers. The movement may be controlled so as to reverse the direction or change the angle of the binder yarns along the woven fabric. This provides for a much stronger woven fabric.

The weaving method enables the production of an angle interlocked weave with or without stuffer yarns. It also allows for the creation of slits or pockets or other discontinuities in the woven fabric. Such discontinuities may accommodate fasteners or the like.

The, or each, group of binder yarns may comprise one or more yarns.

In an embodiment where there is more than one group of binder yarns and one or more of the groups may be moved independently.

The binder yarns of the group may each pass through an eye in a respective heald wire, each heald wire having a plurality of vertically spaced eyes for receipt of yarns from different layers, each wire being movable in a direction along its length to move the binder yarns.

The group of binder yarns may be moveable in unison, preferably by a heald frame, the heald wires for the group being supported in the heald frame.

The heald wires are preferably moved in a direction that is substantially perpendicular to the weaving direction i.e. the direction in which the woven fabric extends as it is woven.

One group of binder yarns may pass through substantially all the layers. Alternatively or in addition, a group of binder yarns may pass through only a restricted number of layers.

The warp yarns of each layer may be threaded through eyes in respective heald wires. Each heald wire may have a plurality of vertically spaced eyes for receipt of warp yarns of different layers. The heald wires may be fixed so that each layer of warp yarns is held is a shed position to allow insertion of the weft yarns.

At least one warp yarn layer may be moved independently of the others during the weaving process so as to change its position in the woven fabric. At least two warp yarn layers may be moved relative to one another so as to change their positions in the woven fabric.

The method may further comprise selectively moving at least one layer of warp yarns relative to the other layer or layers of warp yarns, so as to remove the layer(s) out of the woven fabric or to change its position in the fabric.

In one example, the method comprises selectively moving at least one warp yarn layer outwards of the other warp yarns so that they are removed from the woven fabric. The selected warp yarn layers may be located at any position in the woven fabric. In one example, the outermost warp yarns may be so moved. Alternatively warp yarns from the middle layers may be so moved. In a further alternative selected warp yarn layers are moved relative to one another so that they swap positions in the woven fabric.

The warp yarn layers may be arranged into groups, with one or more groups being moved together.

Looms for Three Dimensional Weaving

According to a further aspect of the present invention there is provided a loom for weaving a three-dimensional fabric comprising:

a shedding assembly comprising at least one support for providing a plurality of separated layers of warp yarns under tension, each layer comprising a plurality of parallel spaced yarns, the separated the layers of warp yarns defining a shed between each layer;

a weft picking mechanism for selectively inserting simultaneously a plurality of parallel weft yarns a predetermined distance into the sheds between the warp yarns;

a binder yarn positioning mechanism for selectively positioning at least one group of binder yarns between parallel spaced yarns of the warp yarn layers; the binder yarn positioning mechanism being operable to selectively move the group of binder yarns through only some of the warp yarn layers, between weft insertions.

As described above in relation to the methods of the invention, the above loom is operable to move the group of binder yarns through only some of the warp yarn layers. In this context, "only some" refers to one or more, but not all. Thus, in the above loom, the binder yarn positioning mechanism is operable to move the group of binder yarns through one or more warp yarn layers, but not through all warp yarn layers, between weft insertions. In embodiments, the binder yarn positioning mechanism is operable to move the group of binder yarns through less than half of the warp yarn layers between weft insertions. In alternative embodiments, the binder yarn positioning mechanism is operable to move the group of binder yarns though at least half or, suitably, more than half of the warp yarn layers between weft insertions. For instance, in embodiments the binder yarn positioning mechanism is operable to move the group of binder yarns through substantially all of the warp yarn layers such as through up to 95%, 90%, 85% or 80% of warp yarn layers between weft insertions. In other words, if twenty warp yarn layers were provided, the loom would be operable to move the group of binder yarns through up to 19, 18, 17 layers or 16 warp yarn layers between weft insertions.

Thus, the binder yarn positioning mechanism is operable to move the group of binder yarns between two or more positions relative to the warp yarn layers during weaving of the fabric. In embodiments, the binder yarn positioning mechanism is operable to move the group of binder yarns between more than two positions relative to the warp yarn layers during weaving of the fabric. In such embodiments, the binder yarn positioning mechanism may be operable to move a group of binder yarns through all of the warp yarn layers between weft insertions, provided that it is also operable to include the step of moving the group of binder yarns between only some of the warp yarn layers between weft insertions.

According to a further aspect of the present invention there is provided a loom for weaving a three-dimensional fabric comprising: a shedding assembly comprising at least one support for providing a plurality of separated layers of warp yarns under tension, each layer comprising a plurality of parallel spaced yarns, the separated the layers of warp yarns defining a shed between each layer; a weft picking mechanism for selectively inserting simultaneously a plurality of parallel weft yarns a predetermined distance into the sheds between the warp yarns; a binder yarn positioning mechanism for selectively positioning at least one group binder yarns between parallel spaced yarns of the warp yarn layers; the binder yarn positioning mechanism being operable to selectively move the group of binder yarns, relative to the warp yarns between weft insertions, between more than two positions relative to the warp yarns during weaving of the fabric.

In an embodiment, the at least one support for providing a plurality of separated layers of warp yarns and/or the binder yarn positioning mechanism may comprise at least one and preferably more than one elongate yarn guide for providing a plurality of separated yarns under tension, said elongate yarn guide comprising first and a second end portions joined by an elongate central body portion, the elongate body portion comprising a plurality of apertures spaced along its longitudinal axis wherein each aperture is configured to receive at least one yarn under tension. In preferred embodiments a plurality of elongate yarn guides is provided. In embodiments wherein the guides are used to support warp yarns, the elongate yarn guides may be supported by a fixed heald frame, suitably wherein at least one of the elongate yarn guides is moveable within the heald frame, and preferably wherein the heald frame is moveable. The binder yarn positioning mechanism may comprise a plurality of said elongate yarn guides for receiving respective binder yarns. The elongate yarn guides may be selectively movable between said more than two positions and may optionally be supported in heald frames.

In embodiments, at least one, optionally more than one, preferably at least half and more preferably more than half (e.g. all) of said elongate yarn guides are heald wires, such as wherein the apertures are heald eyes.

The binder yarn positioning mechanism may comprise a plurality of heald wires having heald eyes for receipt of a respective binder yarn. The heald wires may be selectively movable between said more than two positions. The heald wires may be supported in heald frames.

The shedding assembly may have at least two groups of supports, each for supporting a respective group of warp yarn layers. The supports may be selectively moveable relative to one another so that warp yarn layers may be moved relative to one another. The support groups may each comprise one or more heald wires each with one or more heald eyes. The heald wires may be supported in heald frames.

The warp yarns may pass through eyes in warp heald wires, each warp heald wire having a plurality of vertically spaced eyes for receipt of yarns from different layers.

The warp heald wires are laterally offset from the heald wires for the binder yarns.

In one embodiment all the warp heald wires are supported by a fixed heald frame. In an alternative embodiment at least some of the warp yarn layers are supported in moveable warp heald wires which may be supported in a moveable heald frame, the other warp yarn layers may be supported by fixed or movable warp heald wires that may be supported in a heald frame. The warp yarn layers may be arranged in groups, each group being movable by respective warp heald wires.

According to a further aspect of the invention there is provided a loom for weaving a three-dimensional fabric comprising a shedding assembly comprising:

- a warp yarn support apparatus for providing a plurality of separated layers of warp yarns under tension, each layer comprising a plurality of parallel spaced warp yarns, the separated layers of warp yarns providing a shed between each layer;
- a weft insertion mechanism for inserting weft yarns between the warp yarn layers;
- a binder yarn positioning mechanism operable to position at least one group of binder yarns between parallel spaced yarns of the warp yarn layers between weft insertions,
- wherein the shedding assembly comprises at least one elongate yarn guide for providing a plurality of separated yarns under tension, the elongate yarn guide comprising first and a second end portions joined by an elongate central body portion, the elongate body portion comprising a plurality of apertures spaced along its longitudinal axis, each aperture being configured to receive at least one yarn under tension.

By providing a plurality of apertures spaced along the length of the guides, it is possible to provide a plurality of yarn layers with predetermined spaces between the layers. The elongate shape of the yarn guide also allows for freedom of movement of other yarns alongside the yarn guide.

Elongate Yarn Guides

In typical embodiments, of the above aspects and embodiments, the loom comprises two or more of the elongate yarn guides. Any number of elongate yarn guides may be provided depending on the number of spaced groups of yarns required. For example, from 1-20, 1-10 or 1-5 of said elongate yarn guides may be provided. For example 2, 3, 4, 5, 6, 7, 8, 9, 10 or more of said elongate yarn guides may be provided. This arrangement thus provides a plurality of said elongate yarn guides each comprising a plurality of apertures for receiving yarns under tension, which in turn provides a plurality of separated yarn layers, each layer comprising a plurality of parallel spaced yarns under tension. In other words, a two dimensional array of horizontal and vertical apertures can be provided for supporting a corresponding array of yarns.

Preferably the yarn guides are provided in parallel arrangement. The use of a series of parallel spaced elongate yarn guides then has the benefit of enabling free movement of yarns between the parallel spaced guides in a longitudinal plane relative to the guides.

This is particularly advantageous for use in methods of making three dimensional fabrics such as disclosed herein, where it is desirable to move binder yarns freely in the longitudinal (i.e. vertical) plane between warp yarn layers.

The elongate yarn guides of the present invention are therefore ideal for use in the warp yarn support apparatus for providing a plurality of separated layers of warp yarns under tension, each layer comprising a plurality of parallel spaced warp yarns. The elongate yarn guides may also be used in the binder yarn positioning mechanism. Thus, in an embodiment, the warp yarn support apparatus comprises at least one said elongate yarn guide for providing a plurality of separated warp yarns under tension and/or for providing a plurality of binder yarns under tension. Preferably, two or more of said elongate yarn guides are provided in parallel arrangement. The skilled person may provide as many elongate yarn guides as necessary depending on the desired number of respective yarn layers required.

The elongate yarn guides may be selectively movable between two or more positions, for example more than two positions. In embodiments, the elongate yarn guides may be supported in one or more heald frames.

In a preferred embodiment, said elongate yarn guide is a heald wire comprising a plurality of apertures spaced along its longitudinal axis, each aperture being configured to receive at least one yarn under tension. More preferably, said elongate yarn guide is a heald wire comprising a plurality of heald eyes spaced along its longitudinal axis, each eye being configured to receive at least one yarn under tension.

Accordingly, the invention also provides a heald wire having a plurality of eyes for receipt of yarns (i.e. a multi-eye heald wire). Suitably, the heald wire is for receiving yarns from different yarn layers, such as warp yarns of different layers.

The invention also provides a heald wire for use in a method of preparing a three dimensional woven fabric, the heald wire comprising a plurality of apertures spaced along the longitudinal axis of the wire, each aperture configured to receive one or more yarns.

Suitably, the apertures substantially or completely restrict movement of the yarns to two dimensions, i.e. to allow movement of the yarns forwards and backwards through the apertures, but not allowing up/down or side to side movement in the lateral plane. This allows the user to better control the planar position of the group of yarns within the fabric.

Heald Wire

Suitably, the heald wire may be made of any suitable material, such as metal or plastic. The wire may comprise a single wire or a bundle of two or more wires. The bundle of two or more wires may be joined in any suitable manner. For instance, the bundle may comprise two or more wires twisted together or arranged side by side in parallel conjoined arrangement. The wire may be of any suitable cross-section, for example circular, triangular or square cross-sections.

Apertures

In the above embodiments, the apertures may be provided at substantially regular intervals relative to each other along the longitudinal axis of the elongate body portion. The apertures may be any shape provided the aperture suitably accommodates a yarn. Typically, the apertures have a smooth inner surface to avoid snagging or tearing of the yarn. Preferably, the apertures are therefore substantially oval or circular in shape.

Number of Apertures

The number of apertures will depend on the maximum number of yarn layers required in the three dimensional fabric. For instance, from 2-20 apertures may be provided, such as from 2-10 for examples from 2-5. In embodiments, 2, 3, 4, 5, 6, 7, 8, 9 or 10 apertures may be provided.

Such elongate yarn guides/heald wires according to the embodiments above advantageously allow a large number of warp yarn layers to be provided simultaneously, thus creating a large number of sheds for weft insertion, as well as allowing a large number of binders to be moved with the aid of relatively small number of shedding mechanisms. For instance, ten to twelve servo-driven shedding mechanisms when used in the methods and looms of the present invention can produce structures that are normally produced on Jacquard machines with thousands of shedding mechanisms.

The use of such elongate yarn guides and heald wires also make it possible to hold the warp sheds open throughout the process, thus improving efficiency of the process and reducing wear on the yarns compared to conventional methods which require the sheds a closed and reopened in between weft insertions. Furthermore, by providing elongate yarn guides and heald wires, the present invention allows more freedom of movement for yarns at either side of the guide/wire. This flexibility allows for a wider variety of weaving patterns to be produced compared to conventional approaches, such as wherein the apertures for yarns are provided in plates. For instance, where the apertures of the present elongate yarn guides and heald wires are used to receive a group of warp yarns in the present processes, the binder yarns can be moved freely within the fabric to any desired position.

Moreover, because a large number of warp yarn layers can be accommodated using such elongate yarn guides and heald wires, it is possible to produce significantly thicker fabrics than possible with conventional weaving machines. In conventional weaving, fabric thickness is significantly smaller than width or length of the fabric and the binder yarns extend through the warp yarn layers across the thickness of the fabric. However, because of the availability of large number of sheds and warp yarns (stuffer warps) provided by the present elongate yarn guides and heald wires, it is possible to weave fabrics wherein the binder yarns extend through the warp yarn layers across the width of the fabric, i.e. wherein the width is oriented in Z direction relative to the loom. See for example, FIG. 10*b*. This advantageous feature enables useful fabric structures to be provided that were not accessible by conventional methods. For instance, three dimensional components having angle-interlocked z-binders in the plane of the fabric can be produced, which may be useful for a number of applications requiring bias oriented fibres (i.e. wherein bias fibres are provided in the plane of the fabric) for improved shear and twist resistance.

For example, components with T, H and PI profiles have a number of applications including aircraft stringers as well as reinforcements in wind turbine blades (FIG. 11 shows an exemplary "T" profile component. These profiles require fibres with bias orientation in the web portion (the web portion is the vertical part shown in FIG. 11) and there should preferably be fibre continuity from the web portion to the flange portion (the flange portion is the horizontal part of the inverted T in FIG. 11). T section profiles produced on conventional weaving machines have a weakness at the flange-web interface (due to a resin rich pocket and fibre curvature), as these sections are generally produced flat and then unfolded. Using the methods of the present invention, these sections can be produced in the true T shape form (without the need for folding). Furthermore, unlike conventional three dimensional weaving techniques which provide binder yarns orthogonal to the warp yarns, these sections can advantageously be provided with bias fibres in the web portion as well as providing fibre continuity from the web portion to the flange portion.

According to a further aspect of the present invention there is provided a method for weaving a three-dimensional fabric comprising the steps of: providing a plurality of layers of warp yarns under tension, each layer comprising a plurality of parallel spaced yarns and separating the layers of warp yarns so as to define a shed between each layer; selectively inserting simultaneously a plurality of parallel weft yarns a predetermined distance into the sheds between the warp yarns; selectively positioning at least one group of binder yarns between parallel spaced yarns of the warp yarn layers; and moving at least one warp yarn layer relative to the remaining warp yarn layers after insertion of the weft yarns, so as to remove the at least one warp yarn layer from the woven fabric or so as to change its position in the woven fabric.

According to a further aspect of the present invention there is provided a component made from a composite material comprising a substrate in the form of three-dimensional woven fabric produced according to the method as defined above, the substrate being impregnated with a polymer.

The present invention also provides a component made from a composite material comprising a substrate in the form of three-dimensional woven fabric produced according to a method as defined above, optionally wherein the substrate is impregnated with a polymer. Preferably the substrate is impregnated with a polymer.

According to the invention, a component is provided made from a composite material comprising a substrate in the form of three-dimensional woven fabric. Suitably, the component has a plurality of orthogonally arranged warp and weft yarn layers with binder layers extending progressively through the warp yarn layers in the fabric. Suitably, by extending the binder layers progressively through at least some of the warp yarn layers in the fabric, the general direction of the progression of the binder layers through the fabric is not orthogonal to the warp yarn layers. This allows for better resistance to twisting forces and more options for interlocking binder yarn arrangements. The component may have a T, H or PI profile. Thus, in embodiments, the binder yarns do not extend through the at least some warp yarn layers in a direction that is orthogonal to the warp yarn layers.

LIST OF FIGURES

Specific embodiments of the present invention will now be described, by way of example only, with reference to the accompanying drawings in which:

FIG. 1 is a perspective view of a weaving loom embodying one aspect of the present invention;

FIG. 1*a* is a close-up view of the shedding assembly area of the weaving loom of FIG. 1;

Figure 1:
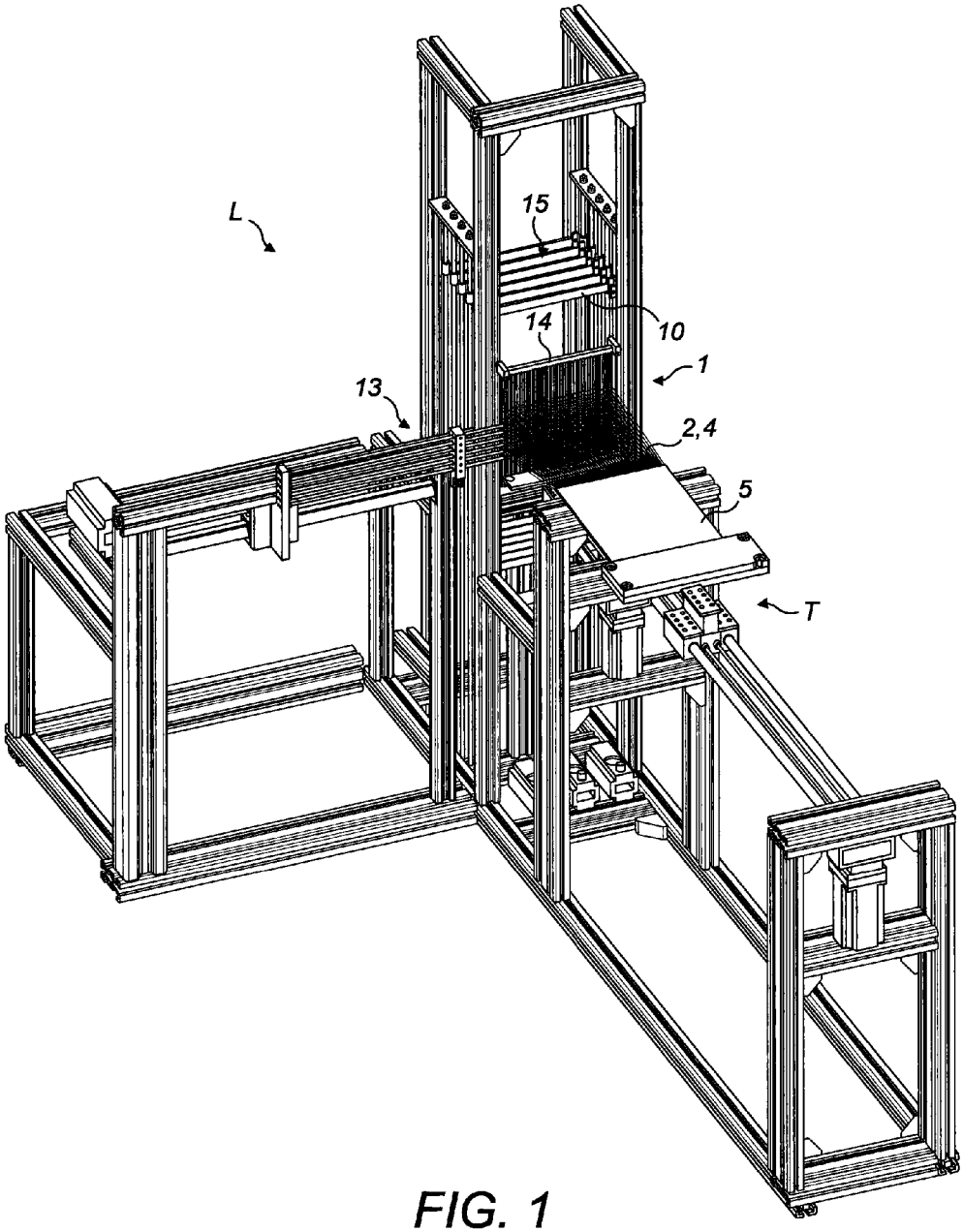
Figure 1A:
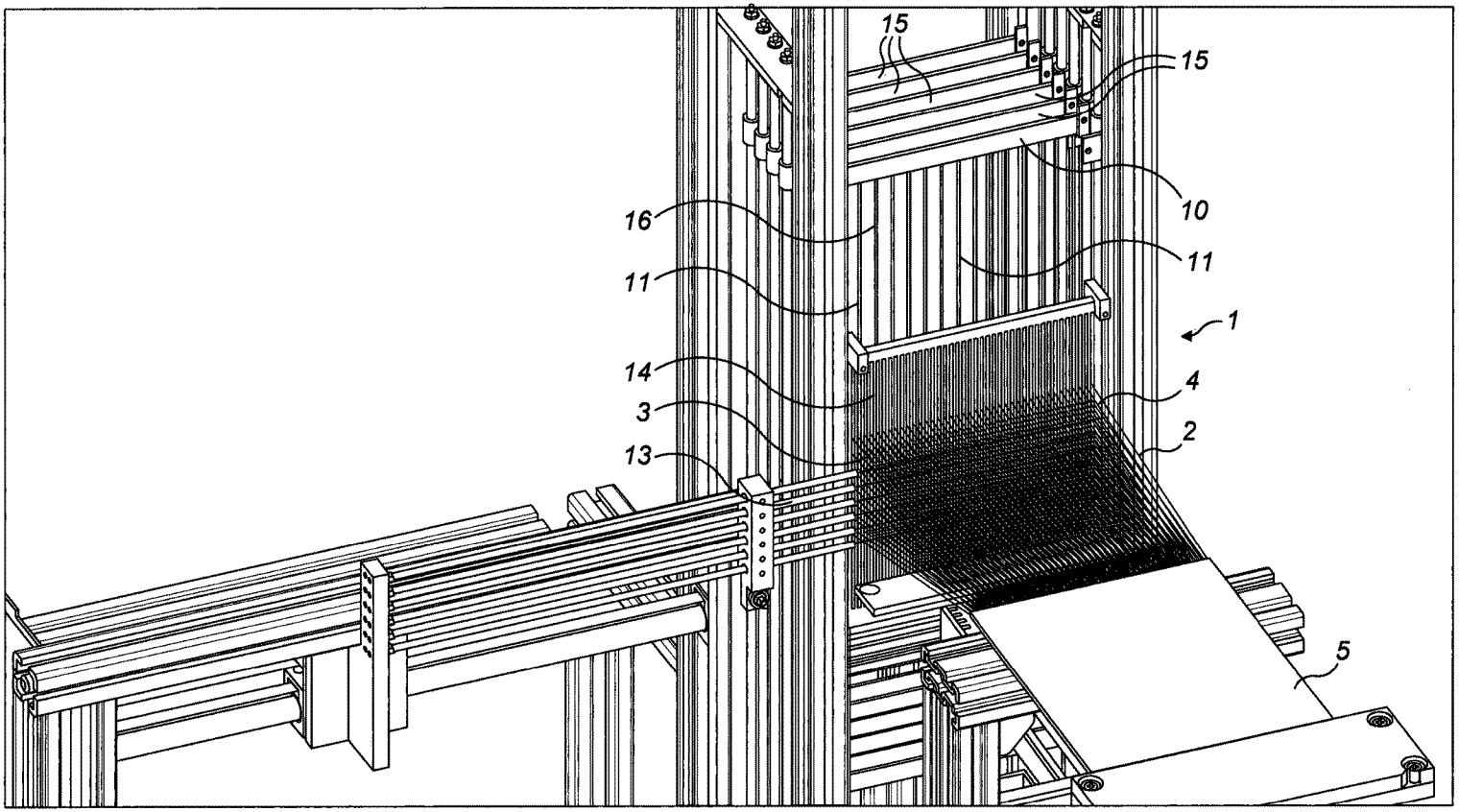
Figure 2:
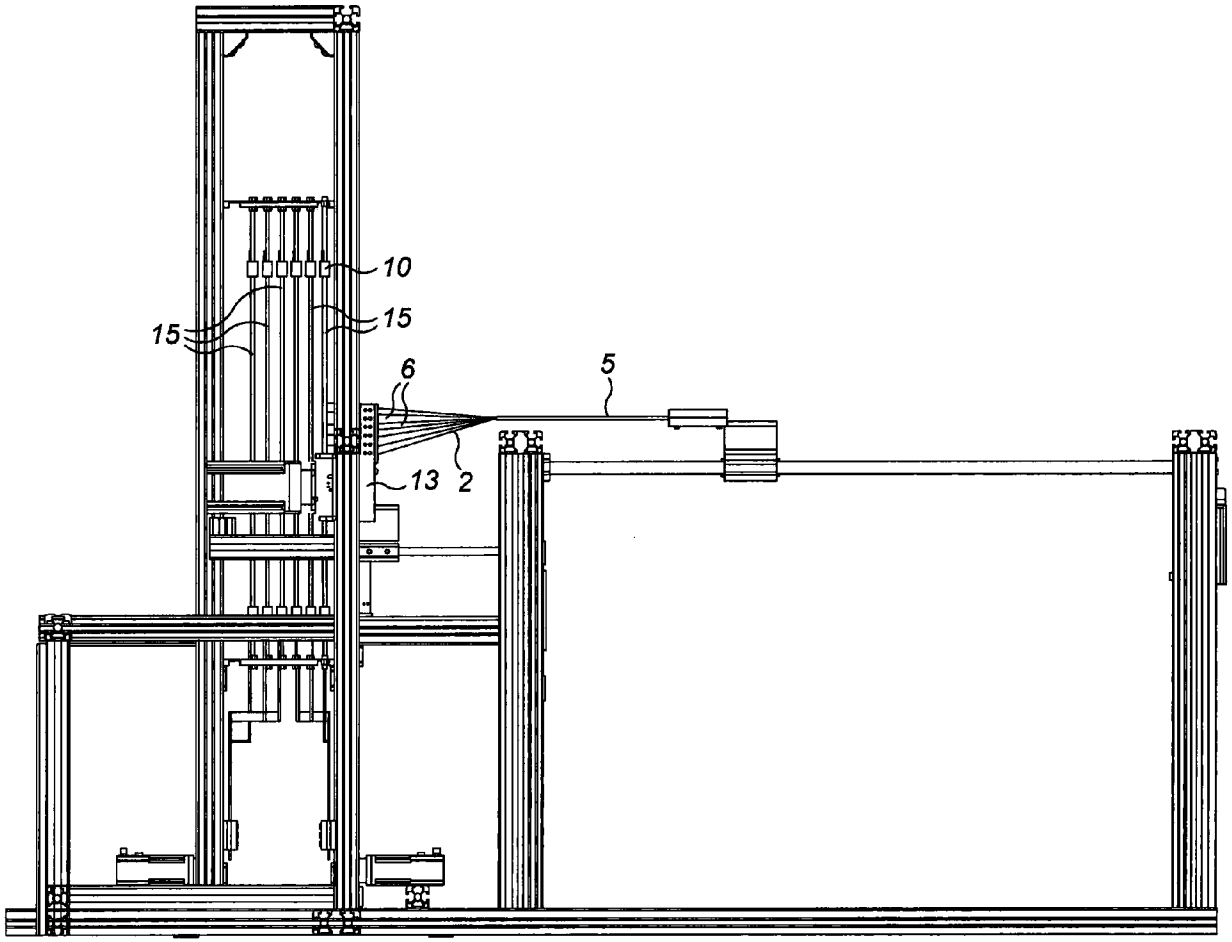
FIG. 2 is a side view of the weaving loom of FIG. 1.
Figure 3A:
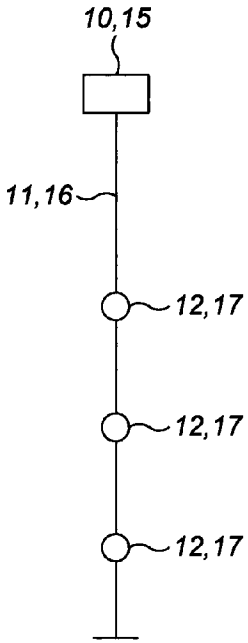
FIG. 3 is a front view of the weaving loom of FIG. 1.
Figure 3:
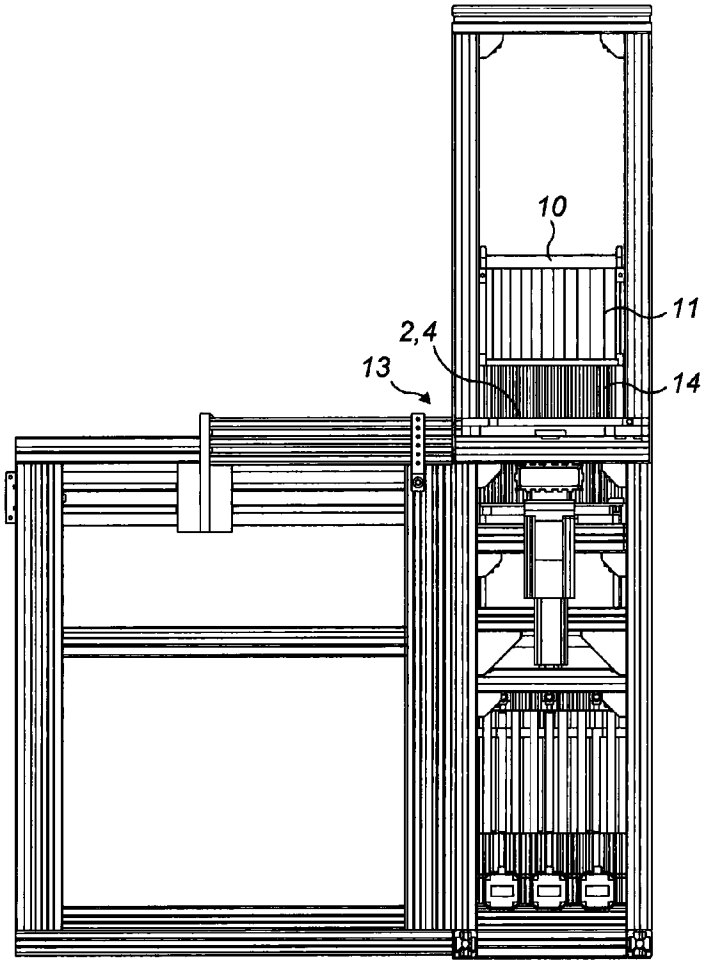
Figure 5A:
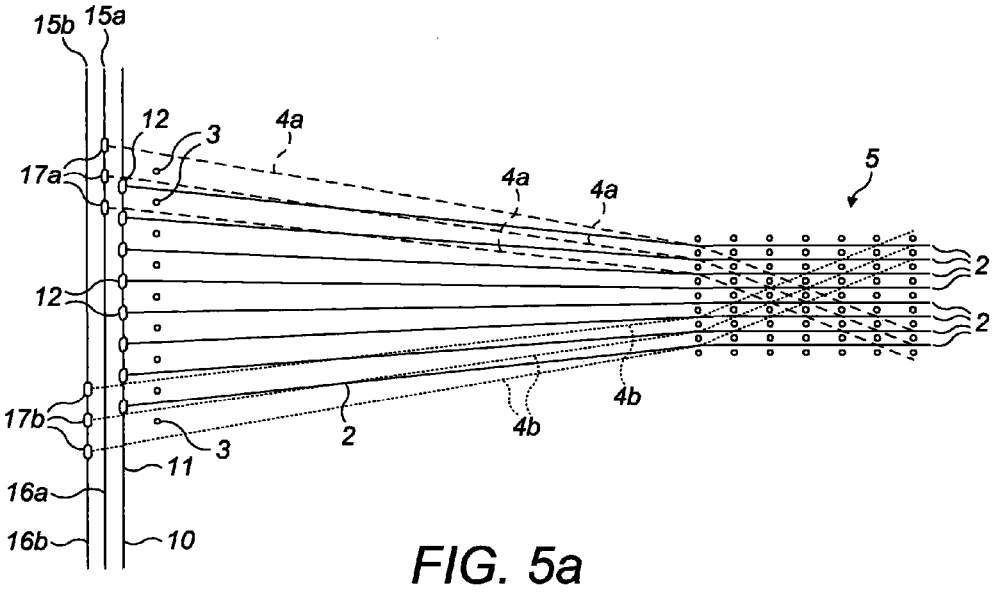
Figure 5B:
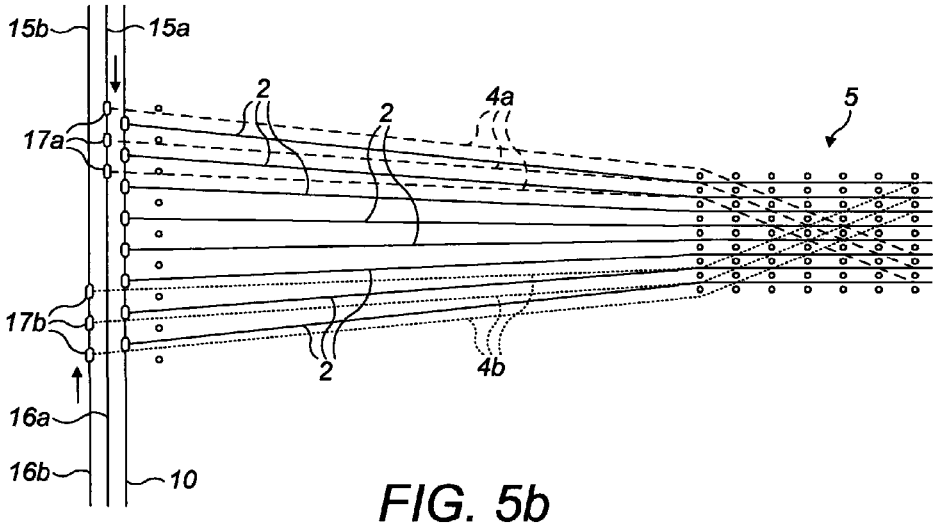
Figure 5C:
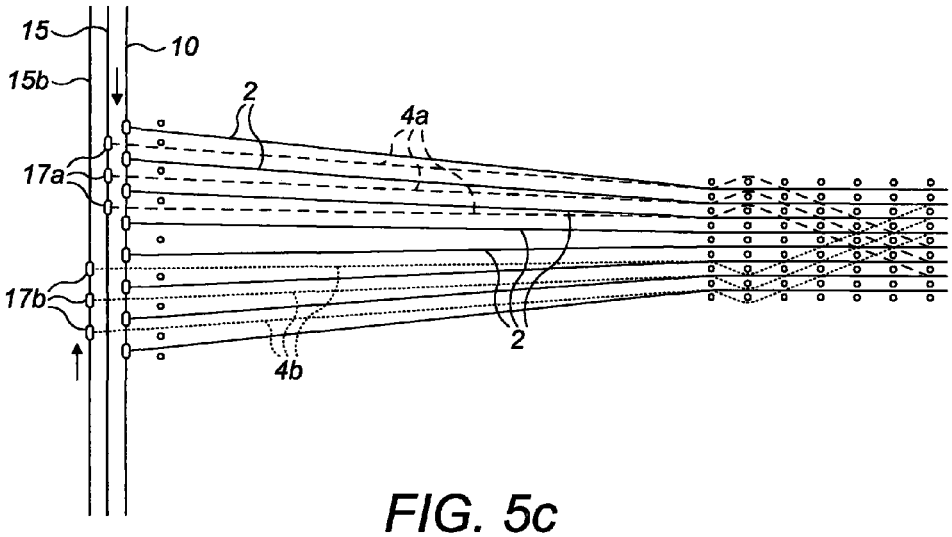
Figure 6A:
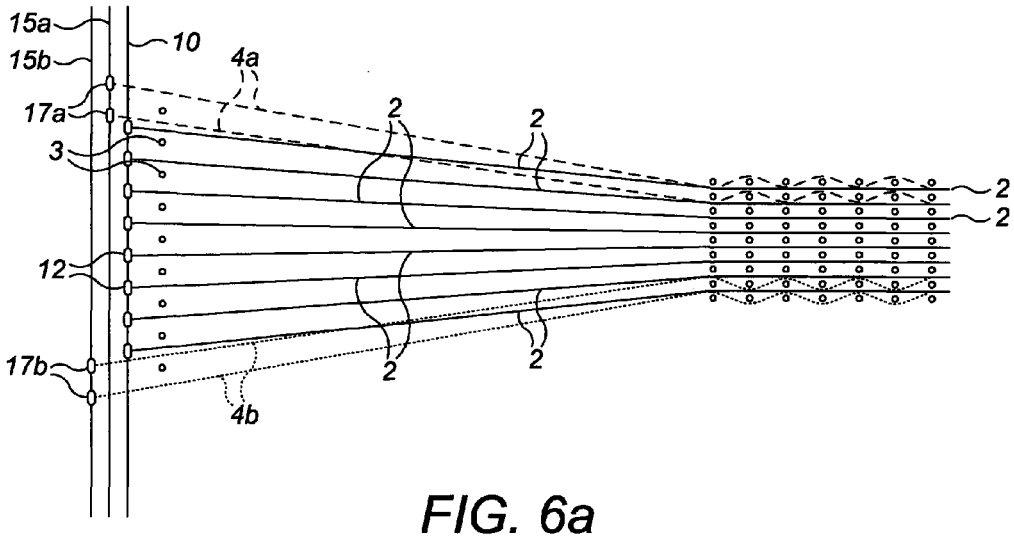
Figure 6B:
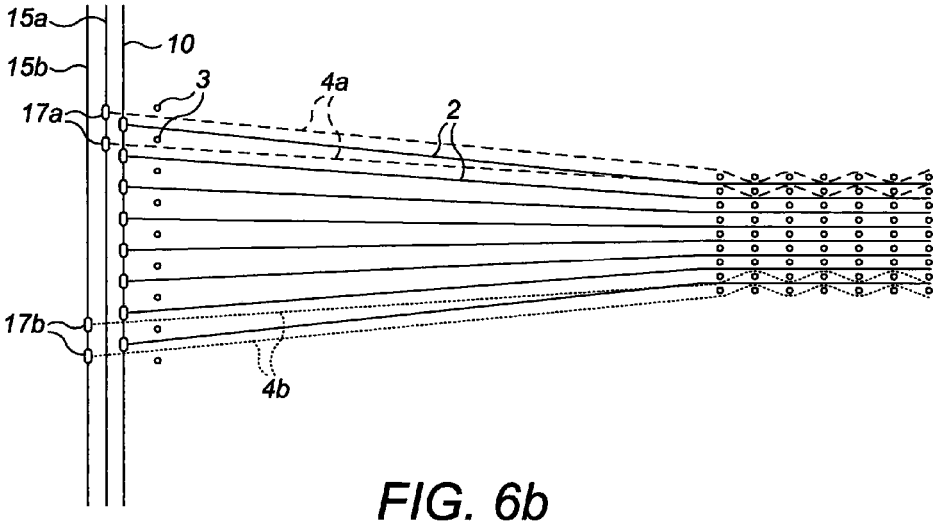
Figure 6C:
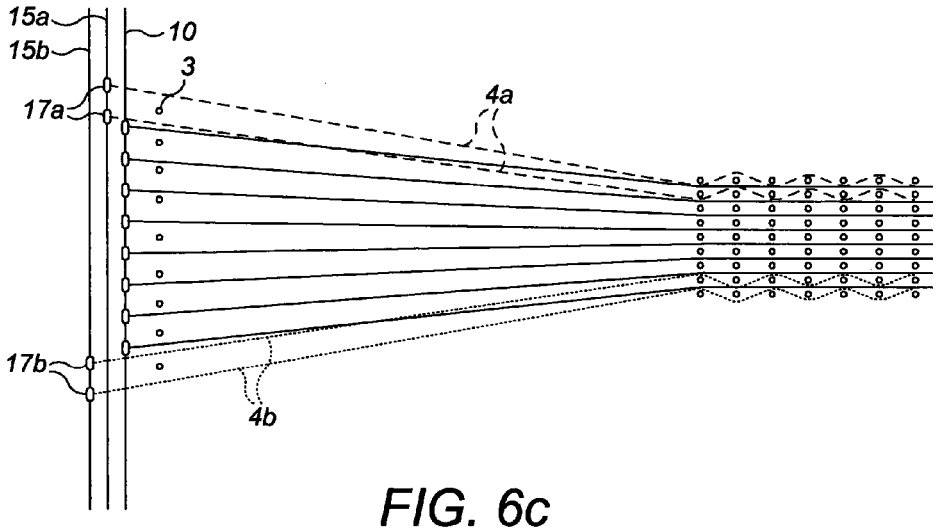
Figure 7A:
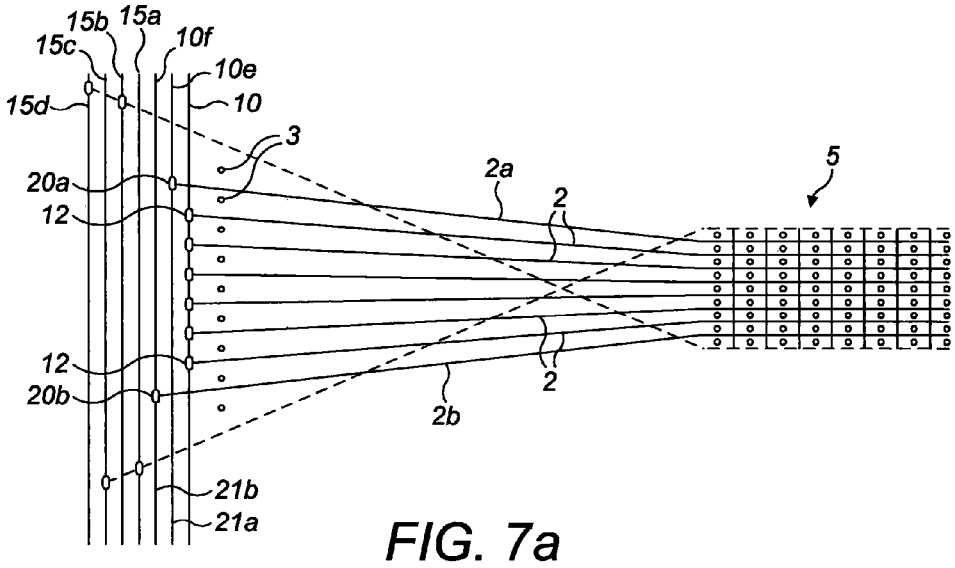
Figure 7B:
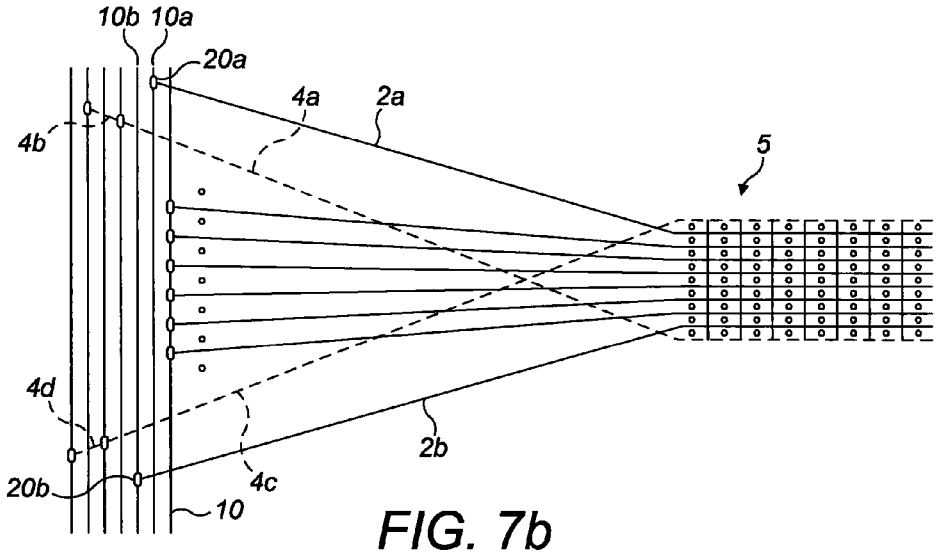
Figure 7C:
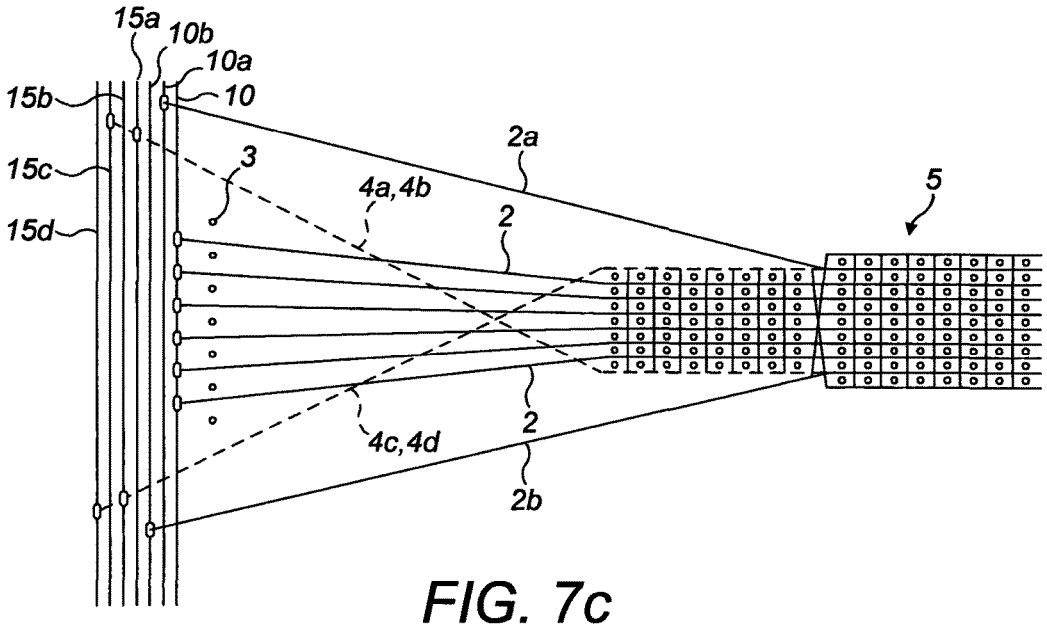
Figure 8A:
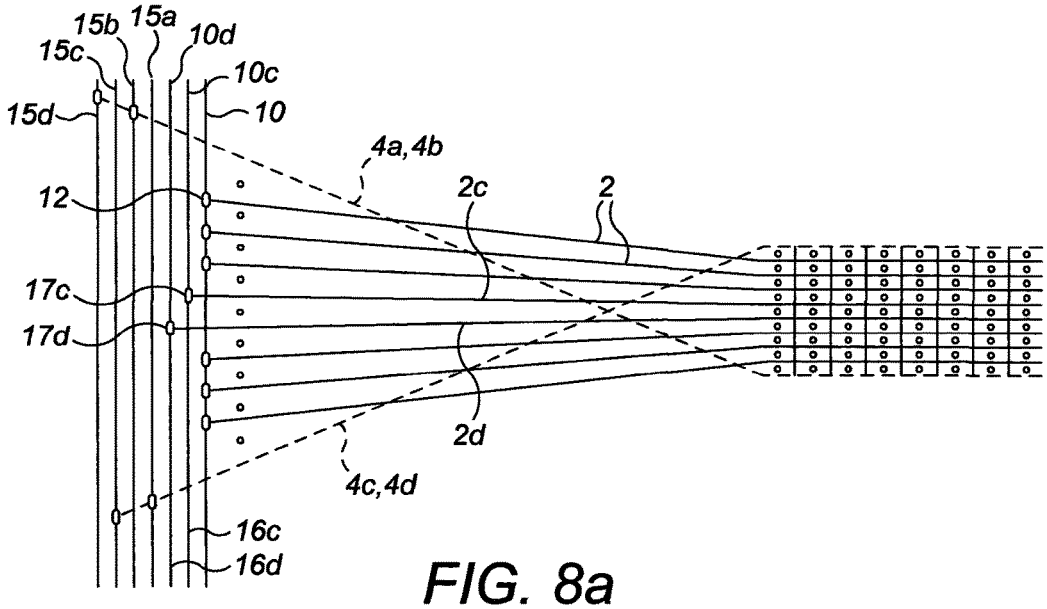
Figure 8B:
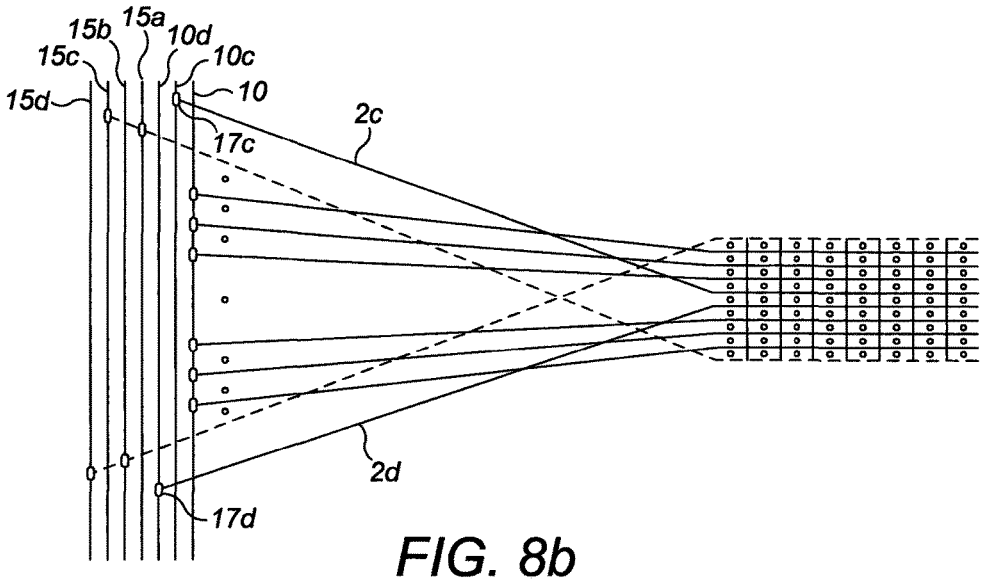
Figure 8C:
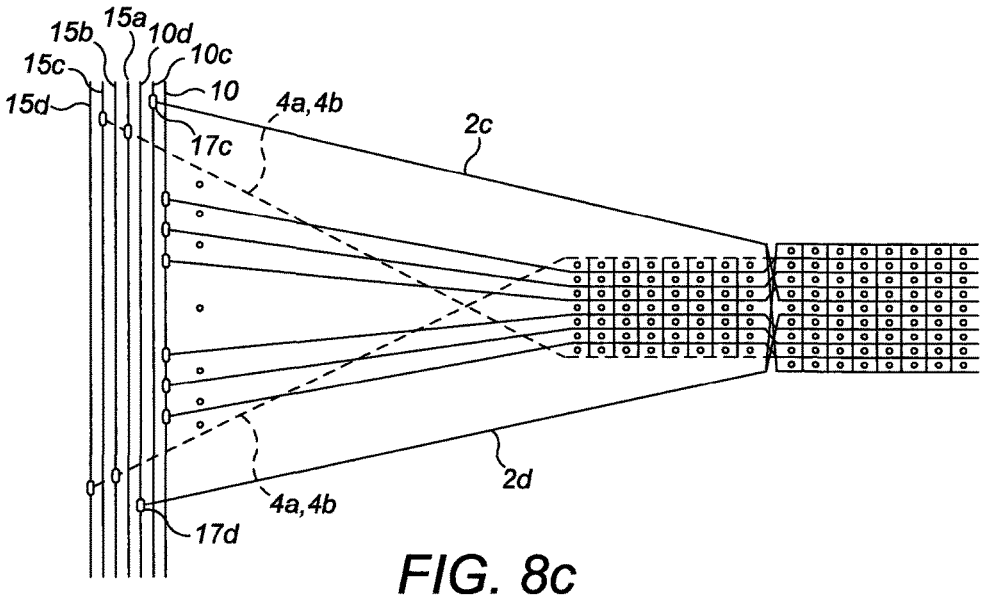
Figure 9A:
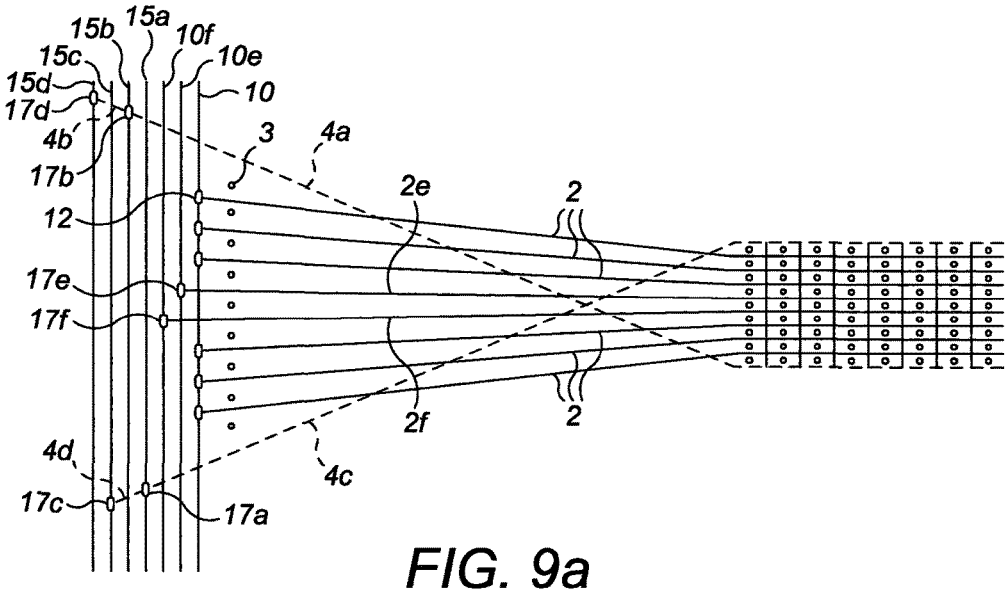
Figure 9B:
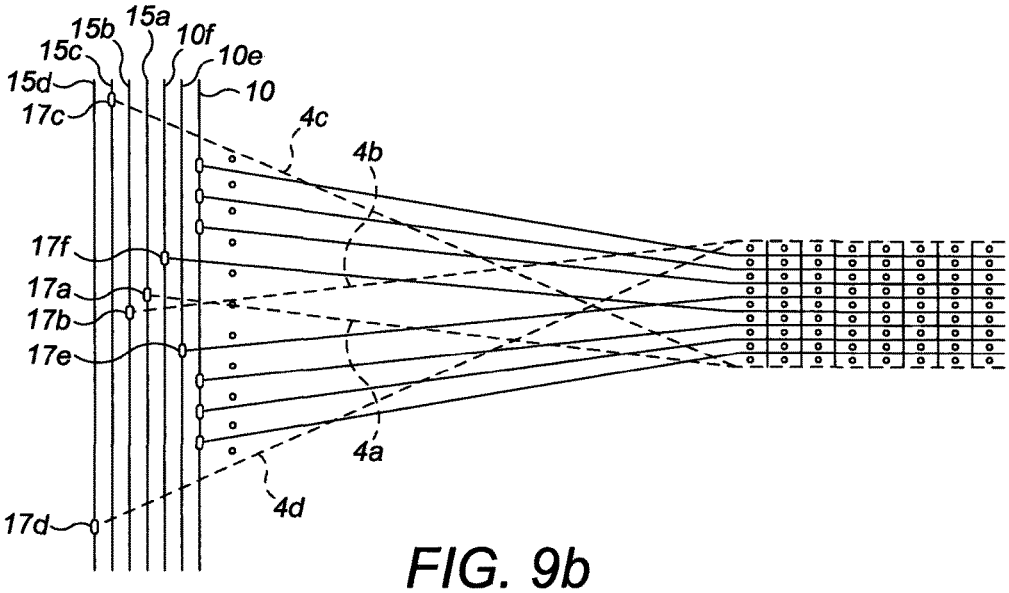
Figure 9C:
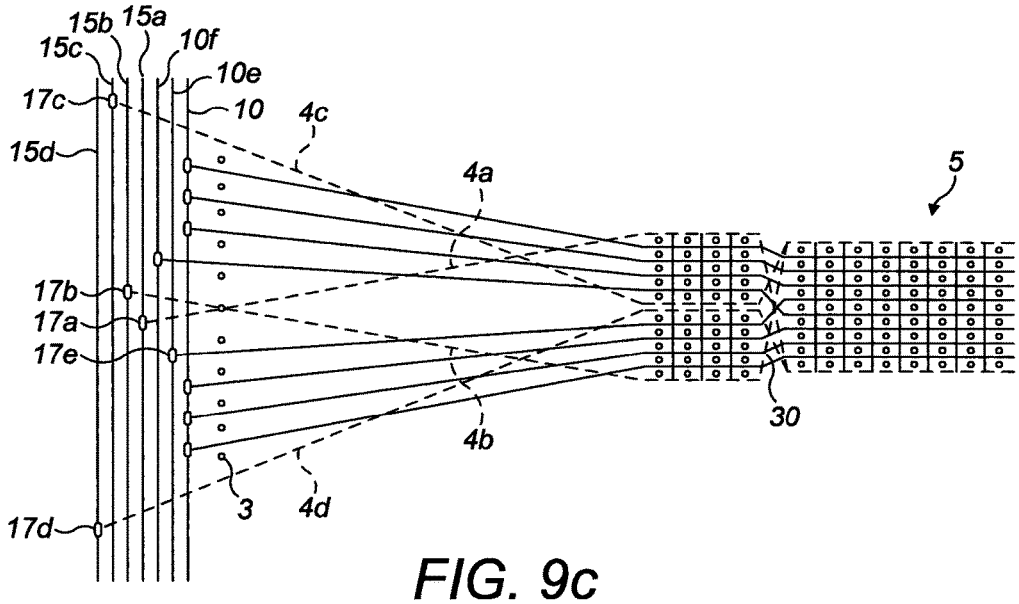

FIG. 3*a* is a schematic representation of part of a heald frame of the weaving loom of FIGS. 1 to 3;

FIGS. 4*a*-4*g* are diagrammatic cross-sectioned views of woven fabrics that may be produced on the loom of FIGS. 1 to 3;

FIGS. 5*a* to 5*c* are schematic side views of a loom in accordance with the present invention, illustrating how binder yarns are moved between weft insertions to achieve an angle interlocked weave;

FIGS. 6*a* to 6*c* are schematic side views of a loom embodying the present invention, illustrating how binder yarns are moved in order to create layer-to-layer weaves;

FIGS. 7*a* to 7*c* are schematic side views of a loom embodying the present invention, illustrating how warp stuffer yarns are moved out of the weaving area in order to create ply drops;

FIGS. 8*a*-8*c* are schematic side views of a loom embodying the present invention, illustrating the removal of warp stuffer yarns from a middle of the weave to create a weave having two separately bound sections; and FIGS. 9*a*-9*c* are schematic side views of a loom embodying the present invention, illustrating the movement warp stuffer layers to produce a slit or pocket.

Figure 10A:
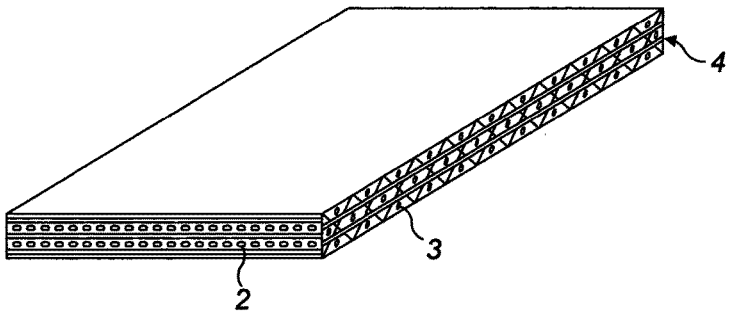
Figure 10B:
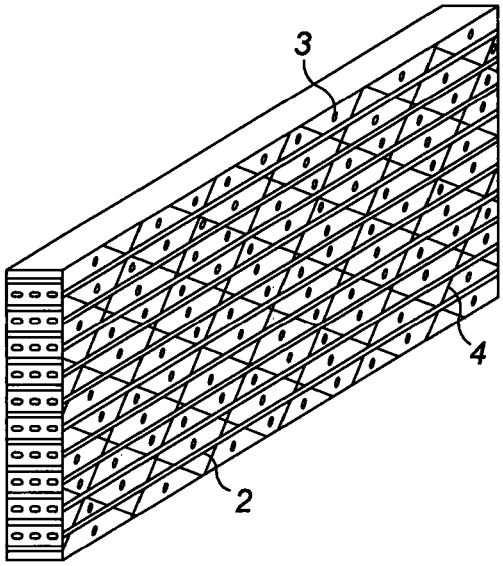

FIGS. 10*a* and 10*b* are perspective views of exemplary components produced according to a method of the present invention.

Figure 11:
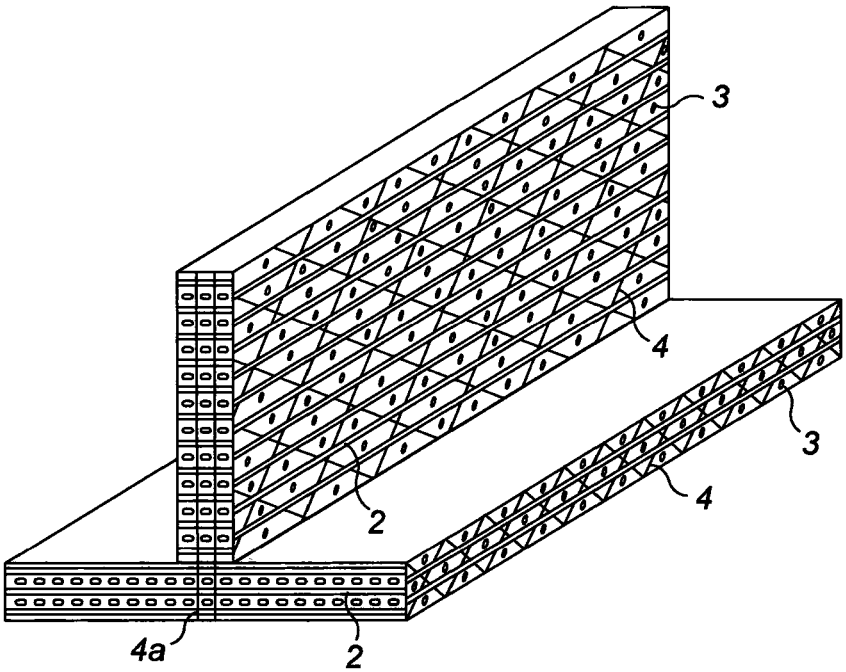

FIG. 11 provides a perspective view of an exemplary component formed as an inverted "T" shape prepared according to a method of the present invention.

DETAILED DESCRIPTION OF FIGURES

FIGS. 1 to 3*a* of the drawings illustrate the shedding assembly 1 of a loom L that operates to weave a plurality of layers of warp yarns 2, orthogonal weft yarns 3 and at least one additional yarn 4 that may be mutually orthogonal to the warp and weft yarns or may be woven in such a manner that it is "off-axis", that is, it extends generally in a direction that is not perpendicular or parallel to either of the warp or weft yarns. The additional yarn typically serves as a binder yarn for binding together the layers of warp and weft.

The loom comprises a framework that provides a supporting structure for the operating parts of the loom. Such framework is not significant to the invention and is therefore not described in detail.

The yarns 2, 3, 4 are supplied under tension from a conventional creel (not shown) to the shedding assembly 1 from where the woven fabric 5 is directed to a take-up area T. The warp yarns 2 are arranged in multiple layers, each layer comprising a horizontal array of parallel yarns and being spaced from the adjacent layer to define a shed 6 (best seen in the side view of FIG. 2) into which a weft yarn 3 may be inserted. The warp yarns 2 pass through a first heald frame 10 that comprises a plurality of parallel heald wires 11, each having eyes 12 for receipt of respective yarns (the eyes are hidden in FIGS. 1 to 3 but an example of part of one heald wire 11 with three heald eyes 12 is shown in FIG. 3*a*). One warp yarn 2 from each layer passes through each eye 12 in the heald wire 11. The eyes 12 serve to shed the warp yarns 2 so as to allow insertion of the weft yarns 3.

The weft yarns 3 are arranged in a vertical array and are picked simultaneously between the warp yarns 2 in the perpendicular direction. The weft yarns 3 are inserted from one side by a suitable picking mechanism. In this particular embodiment the picking mechanism comprises a rapier 13, which is of known construction in the industry and is not therefore described any further.

As is convention in a loom of this kind the weft yarns 3 are beat-up by a reed 14 that is ordinarily disposed at a location between the first heald frame 10 and the rapier 13 but is movable along the weave direction to push the newly inserted weft yarn securely against the fell of the fabric 5. The first heald frame 10 generally remains in a fixed location as the position of the warp yarns 2 does not vary. However, in some embodiments it may be movable, as will be described below.

One or more additional heald frames 15 are located in parallel to the first heald frame 10 and are designed to support the insertion of one or more additional "binder" yarns 4. The binder yarns 4 extend between the warp yarns 2 and in the same general direction. Each of the additional heald frames 15 is supported so that it is movable in the vertical direction, perpendicular to both the warp and weft yarns 2, 3. The movement of the frame is effected by a servo-controlled actuator such as a stepper motor (not shown) so that it may be located in one of many vertical positions. The control of the actuator may be such that the frames 15 are moved between a discrete number of positions, the number being greater than two. In one exemplary embodiment the number corresponds to the number of warp layers. In an alternative embodiment the number corresponds to the number of warp layers plus or minus one or two. In a further alternative the control may have such a fine resolution such that the frame may effectively occupy any chosen position.

Each of the additional heald frames 15 supports a group of parallel heald wires 16 spaced apart along the frame 15 and extending in the vertical direction. Each of the wires 16 has one or more eyes 17 through each of which a binder yarn 4 may be threaded (see FIG. 3*a*). The additional frames 15 are positioned relative to the first heald frame 10 such that the respective groups of heald wires 16 are laterally offset so as to allow the binder yarns 4 pass in the spaces between the warp yarns 2.

In operation the heald frames 15 are selectively moved relative to the warp heald frame 10 so that the binder yarns 4 are moved (via the heald wires 16 and eyes 17) relative to the warp yarns 2 and weft yarns 3. The binder yarns 4 are thus progressively moved through successive layers of the warp yarns 2 in the woven fabric 5.

Figure 4A:
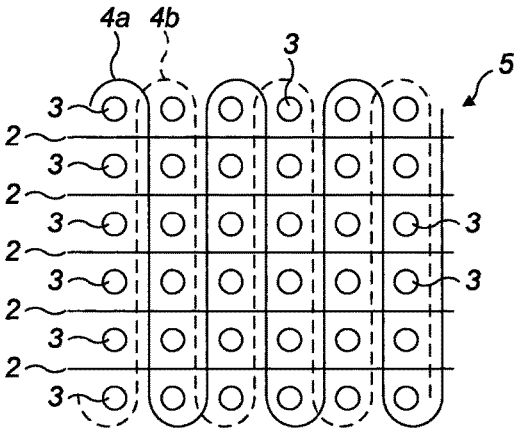

FIGS. 4*a* to 4*g* show cross-sectioned views of different weaves that may be performed using the loom of FIGS. 1 to 3. In FIG. 4*a* a conventional orthogonal weave comprises warp yarns 2, orthogonal weft yarns 3 (extending in a direction perpendicular to the plane of the paper) and two binder yarns 4*a*, 4*b* that extend in a vertical direction orthogonal to both the warp and weft yarn directions. The binder yarns 4*a*, 4*b* extend across all the warp yarn layers 2.

Figure 4B:
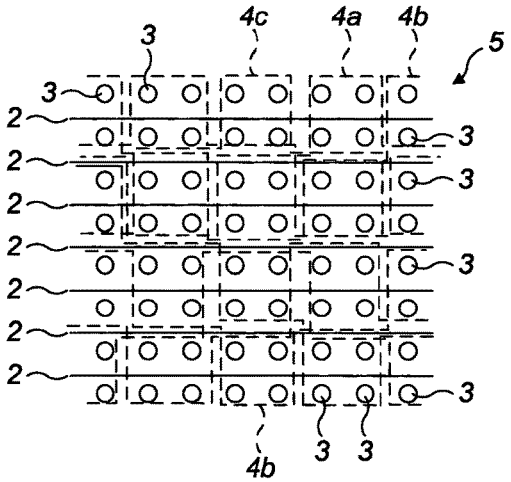

FIG. 4*b* shows a modified orthogonal weave in which three sets of binder yarns 4*a*, 4*b*, and 4*c* extend step-wise through the fabric. Each binder yarn 4*a*, 4*b*, 4*c* has sections that extend vertically past two adjacent weft yarns 2 in a single weft insertion and horizontal sections that extend over two successive weft insertions 3 in a direction that extends parallel to the warp yarn 2. Each binder yarn 4*a*, 4*b*, 4*c* may extend up and down the fabrics in the orientation shown in the figure.

Figure 4C:
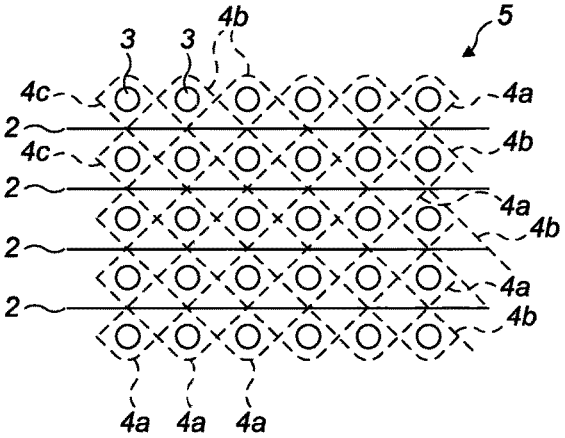

FIG. 4*c* illustrates an angle interlocked weave in which the binder yarns 4*a*, 4*b* pass in a direction that is off-axis. The binder yarns 4*a*, 4*b* and pass progressively through all the layers, one layer at a time between weft insertions.

Figure 4D:
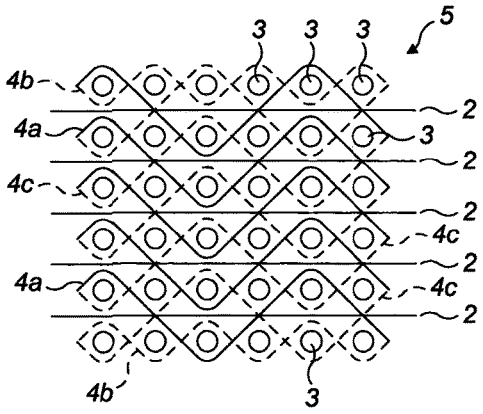

FIG. 4*d* illustrates a weave in which the binder yarns 4*a*, 4*b*, 4*c* pass between one or two layers of warp stuffer yarns but not across the full thickness of the fabric 5, so as to provide layer-to-layer binding. Again, the binder yarns pass is a direction that is off-axis. It will be appreciated that the respective heald frames 15 may be moved so that the binder yarns 5 are shedded so as to pass through any number of layers. In the particular embodiment shown, the binder yarns pass between two layers of warp yarns 2 only. It will be appreciated that in other embodiments they may pass progressively between more warp yarn layers.

Figure 4E:
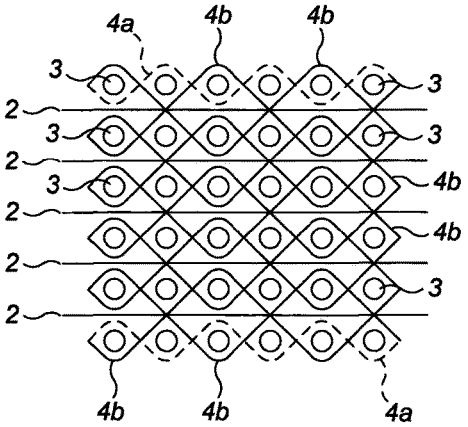

FIG. 4*e* is a variation of the weave shown in FIG. 4*d* and shows only two sets of binder yarns 4*a*, 4*b*; one binder yarn, 4*a*, passing in alternate directions between weft insertions 3 through a single yarn layer 2, the other passing progressively through two yarn layers 2 and then reversing its direction back through the same two layers.

Figure 4F:
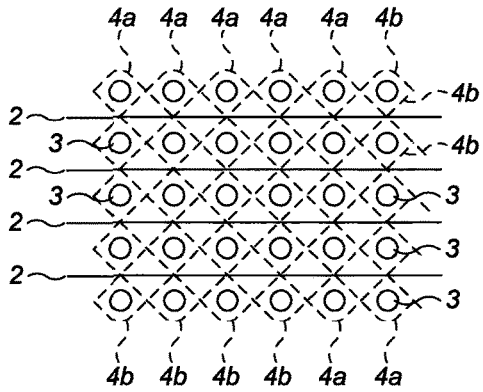

FIG. 4*f* shows an angle interlocked weave corresponding to that of FIG. 4*c* in which there are only two sets of binder yarns 4*a*, 4*b*.

Figure 4G:
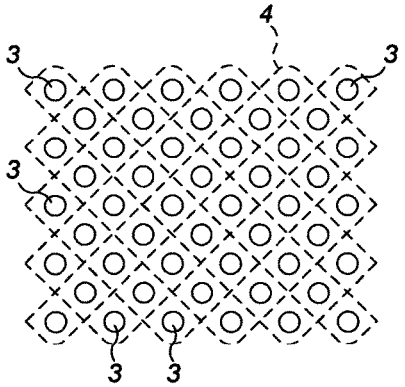

FIG. 4*g* illustrates an angle interlocked weave without warp stuffers.

FIGS. 5 to 9 are schematic diagrams intended to illustrate the movement of heald frames and therefore binder and/or warp yarns between weft insertions. The heald frames are represented schematically with only part of a single heald wire being depicted for each frame. As a consequence their movement is best understood by reference to the positions of the heald frame eyes. It will be appreciated that the warp and binder yarns extend rearward of their respective heald frames, but this is omitted for the sake of clarity and ease of understanding.

FIGS. 5*a*-5*c* show an embodiment of the loom in which the first heald frame 10 for the warp yarns 2 is disposed at the front of other heald frames 15*a*, 15*b*, immediately behind the weft picking mechanism. The warp yarns 2 of each layer pass through an eye 12 in each heald wire 11, the eyes 12 of each layer being horizontally aligned.

There are eight layers in all and therefore the warp yarns 2 pass through eight vertically spaced eyes 12 in each heald wire 11. The first heald frame 10 remains fixed in this embodiment.

The weft yarns 3 are shown inserted into the sheds between the warp yarns 2, immediately adjacent to the first heald frame 10, prior to being beaten into the woven fabric by the reed (not shown). Behind the first heald frame 10 (i.e. in the direction away from the fell) there is a plurality of further heald frames 15*a, b* for the binder yarns 4. In this particular embodiment only two further heald frames are shown for ease of understanding. It will be understood that additional heald frames may be provided. A second heald frame 15*a*, for example, has multiple heald wires 16*a* (only one shown in the figure as the others are hidden behind) arranged across its width, each heald wire 16*a* having three vertically spaced eyes 17*a* for supporting a group of three binder yarns 4 as they are moved through the warp layers 2 in an off-axis direction. It can be seen in the woven fabric 5 that the binder yarns 4*a* progress through the fabric layers gradually by virtue of incremental movement of the second heald frame 15*a* in a vertical direction, each incremental movement occurring between weft insertions. Similarly a second group of three binder yarns 4*b* progresses in the opposite direction, their movement being controlled by the movement of heald frame 15*b*, which is immediately behind heald frame 15*a*. Heald frame 15*b* has heald eyes 17*b* supported by heald wires 16*b*. The incremental movement of the heald frames 15*a*, 15*b*, and therefore the binder yarns, can be seen by comparing the positions of the heald frame eyes in each of FIGS. 5*a*-5*c*.

FIGS. 5*a*, 5*b* and 5*c* show, in a chronological sequence, the weaving process. Between each of the temporal snapshots represented by the figures, the weft yarns 3 shown in the sheds between the warp yarns 2 are beaten up by the reed (not shown) into the woven fabric shown on the right. A comparison of FIGS. 5*a* and 5*b* shows that heald frame 15*a* has moved vertically down one increment from the position shown in FIG. 5*a* to that shown in FIG. 5*b*. This causes corresponding movement of the heald eyes 17*a* and displaces the binder yarns 4*a* downwards relative to the weft yarns 3 and warp layers 2. For example, in FIG. 5*a* the uppermost binder yarn 4*a* is shown outboard of the uppermost weft yarn 3 but in FIG. 5*b* it has moved inboard of the uppermost weft yarn. Similarly heald frame 15*b* moves up by one increment. In FIG. 5*c* both heald frames 15*a*, 15*b* have moved a further step inwardly of the shedding assembly. It can be seen from an inspection of the woven fabric on the right that the binder yarns 4*a*, 4*b* progressively extend at an angle to the warp layers 2 so as to provide an angle interlocked weave. It will be understood that the number of binder yarn groups may be increased by using more heald frames 15. Only two moving heald frames 15*a*, 15*b* are shown here for clarity and in order to demonstrate the principle.

In FIGS. 6*a*, 6*b* and 6*c*, the first heald frame 10 for the warp yarns 2 remains fixed and each of the second and third frames 15, 15*b* reciprocates in the vertical direction, between weft insertions, such that it alternates between two positions. Thus, in FIG. 6*c*, the heald frames 10, 15*a*, 15*b* all occupy the same positions as they did in FIG. 6*a*. This produces layer-to-layer binding. Although only two binder yarns in each group are shown it will be understood that this number may be varied depending on the application. Moreover, the second and third heald frames 15*a*, 15*b* may be moved sequentially to further positions such that the binder yarns 4*a*, 4*b* each extend progressively through more than one warp layer 2 and fewer than all the layers (as depicted in FIG. 5). As in FIG. 5, the number of heald frames may be increased to provide additional binder yarn groups.

In FIGS. 7*a* to 7*c* the outermost warp yarns 2*a* in the weave are threaded through separate heald frames 10*a*, 10*b* to the other warp yarns 2. These additional heald frames are disposed between the first heald frame 10 for shedding the warp yarns 2 and subsequent heald frames 15*a*, 15*b*, 15*c*, 15*d* that control the position of the binder yarns 4. The outermost layers of warp yarns 2*a*, 2*b* are threaded through eyes 20*a*, 20*b* in heald wires 21*a*, 21*b* of respective heald frames 10*a*, 10*b*. As shown in FIG. 7*b*, vertical movement of the second heald frame 10*a* through a predetermined distance in an upwards direction serves to move the upper layer 2*a* of warp stuffer yarns out of the weaving area, and thus out of the fabric 5, in order to create ply drop (in which the number of layers in reduced). Similarly downwards vertical movement of the third heald frame 10*b* through a predetermined distance (as also shown in FIG. 7*b*) serves to move the lower layer 2*b* of warp stuffer yarns out of the weaving area and create a further ply drop. The connecting floats (unwoven parts of the warp yarns 2*a*, 2*b*) may be removed. The plies can be reintroduced if required by moving the second and third heald frames 10*a*, 10*b* back to the positions shown in FIG. 7*a*. This arrangement may be used in combination with one or more additional heald frames 15*a* etc. for binder yarns. In this exemplary embodiment four such additional heald frames 15*a* to 15*d* are illustrated and control the positions of four groups of binder yarns 4*a*, 4*b*, 4*c*, 4*d* (for a large part of their length binder yarns 4*b* and 4*d* are hidden behind yarns 4*a* and 4*c*).

A comparison of FIGS. 7*a* and 7*b* shows that heald frames 15*a* and 15*c* have moved upwards and heald frames 15*b* and 15*d* downwards. This movement serves to move the binder yarns through all of the warp yarn layers (by virtue of being threaded through respective eyes in heald wires). It will be understood that other forms of binding weaves (such as, for example, angle interlocking) may be used.

In FIG. 7*a* it can be seen that the binder yarns 4*a*-4*d* have passed vertically through all the warp layers 2. After the outermost warp yarns 2*a*, 2*b* have been removed from the weave as shown in FIG. 2, the binder yarns 4*a*-4*d* may serve to bind the warp yarns 2 in upper and lower sections as can be seen in FIG. 7*c*, which illustrates the position after eight further weft insertions.

FIGS. 8*a* to 8*c* illustrate a similar principle to that shown in FIGS. 7*a* to 7*c* only in this instance warp stuffer yarns 2*c*, 2*d* from the middle layers are moved outside of the weave by moving respective heald frames 10*c*, 10*d* in opposite vertical directions (see FIG. 8*b*). This may provide for a stronger fabric as the outermost warp layers 2 are continuous. As in the embodiment of FIGS. 7*a* to 7*c* the fabric is reduced in thickness and the binder yarns 4*a*-4*d* may bind the remaining warp yarns in upper and lower sections. FIG. 8*c* illustrates the position after eight further weft insertions, the positions of the second and third heald frames 10*c*, 10*d* remaining unchanged from the positions shown in FIG. 8*b*.

In the embodiment of FIGS. 9*a* to 9*c*, the warp yarns 2 are shed by three separate heald frames 10, 10*e* and 10*f*. A first of the frames 10 supports an upper three warp yarn layers 2 and a lower three warp yarn layers 2. The second frame 10*e* supports a one of the middle warp yarn layers 2*e* in heald eyes 17*e* whereas the third frame 10*f* supports another middle warp yarn layer 2*f* in heald eyes 17*f*. In FIG. 9*a* the frames 10, 10*e*, 10*f* are shown in a first position which is equivalent to all the warp yarns 2 being supported by a single frame as in the embodiments of FIGS. 1 to 6. In FIG. 9*b* the two frames 10*e*, 10*f* have swapped vertical locations so that the middle warp stuffer yarns 2*e*, 2*f* swap positions. This technique may be used to create a pocket or slit 30 in the woven fabric 5, as illustrated in FIG. 9*c*. The frame positions may move back to their original positions after a predetermined number of weft insertions.

The number of heald frames supporting the warp yarn layers 2 may vary depending on the number of such layers that require movement. In one example, the warp yarn layers are separated into two groups of upper and lower layers, each group being supported in separate frames. At a predetermined point in the weaving process those frames swap positions such that upper and lower also swap positions in the woven fabric.

In the example shown in FIGS. 9*a* to 9*c*, the binder yarns 4*a*-4*d* are initially in the position shown in FIG. 9*a* in which yarns 4*b* are hidden behind yarns 4*a* for most of their length and similarly yarns 4*b* are hidden behind yarns 4*c*. In FIG. 9*b* it can be seen that heald frame 15*a* has moved upwards, taking with it binder yarns 4*a* (in heald eyes 17*a*) such that the yarns 4*a* are towards the middle of the weave. Similarly heald frame 15*b* has moved downwards so as to move the binder yarns 4*a* (via heald eyes 17*b*) towards the middle of the woven fabric. From this position onwards the two frames 15*a*, 15*b* continue to alternate between the positions shown in FIGS. 9*a* and 9*b* so as to bind the warp yarns 2 in upper and lower sections, as can be seen in FIG. 9*c*. Heald frames 15*c*, 15*d* and binder yarns 4*c*, 4*d* operate in the same fashion but move greater distances so that binder yarns 4*c*, 4*d* extend through all the warp layers 2 between weft insertions so as to ensure the two sections are bound together.

FIGS. 10*a* and 10*b* show exemplary components of the invention prepared according to a method of the invention, each having a length, a width, and a thickness. In FIG. 10*a*, the warp yarns 2 extend along the length of the fabric, the weft yarns 3 extend across the width of the fabric and the binder yarns 4 extend progressively through the warp yarn layers across the thickness of the fabric in a direction that is not orthogonal to the warp yarns. In the component of FIG. 10*b*, the warp yarns 2 extend along the length of the fabric, the weft yarns 3 extend across the thickness of the fabric and the binder yarns 4 extend progressively through the warp yarn layers across the width of the fabric in a direction that is not orthogonal to the warp yarns.

FIG. 11 shows an exemplary inverted "T" shape component prepared according to a method of the invention. The binder yarns 4 in the horizontal bottom portion (i.e. the flange portion) extend progressively through the warp yarn layers across the thickness of the fabric as in FIG. 10*a*, whereas the binder yarns 4*a* in the vertical raised portion (i.e. the web portion) extend progressively through the warp yarn layers 2 across the width of the web portion of the fabric as in FIG. 10*b*.

As in all previous embodiments it will be appreciated that the number of heald frames for the binder yarns may vary, depending on the number of binder yarn groups required.

The fibres used in the methods described above may be, for example, of any suitable kind including, for example, carbon, glass, aramid, Kevlar or a mixture thereof. They may be mixed with conventional textile fibres.

The methods describe above enable the production of three-dimensional fabrics with, optionally, off-axis (non-orthogonal) fibres using a relatively simple and compact loom with reduced distortion or damage to the fibres. It also allows the production of significantly thicker fabrics than has hitherto been possible. A variety of weave styles are possible as discussed above.

Using the above described methods it is possible to produce pre-pregs (pre-impregnated woven structures) that are very close to the desired final shape of the composite component. Such woven fabric structures may be impregnated by any known process such as, for example, resin transfer moulding.

It will be appreciated that numerous modifications to the above described design may be made without departing from the scope of the invention as defined in the appended claims. For example, rather than being supported in movable heald frames in a Dobby-type loom as described above, the heald wires may be arranged into groups, the wires of each group being movable together in unison under the control of, for example, a computer controlled servoactuator, as if connected together by a supporting frame or other structure. This arrangement may be provided on, for example, a Jacquard type loom.

The described and illustrated embodiments are to be considered as illustrative and not restrictive in character, it being understood that only the preferred embodiments have been shown and described and that all changes and modifications that come within the scope of the inventions as defined in the claims are desired to be protected. It should be understood that while the use of words such as "preferable", "preferably", "preferred" or "more preferred" in the description suggest that a feature so described may be desirable, it may nevertheless not be necessary and embodiments lacking such a feature may be contemplated as within the scope of the invention as defined in the appended claims. In relation to the claims, it is intended that when words such as "a," "an," "at least one," or "at least one portion" are used to preface a feature there is no intention to limit the claim to only one such feature unless specifically stated to the contrary in the claim. When the language "at least a portion" and/or "a portion" is used the item can include a portion and/or the entire item unless specifically stated to the contrary.

The invention claimed is:

1. A method for producing a three dimensional woven fabric, the method comprising:

providing a plurality of layers of warp yarns under tension, such that there is a top warp yarn layer corresponding to the top of the fabric, a bottom warp yarn layer corresponding to the bottom of the fabric, and at least one warp yarn layer interposed between the top and bottom warp yarn layers, each layer comprising a plurality of parallel spaced yarns, and separating the layers of warp yarns so as to define a shed between each layer;

in a weft insertion step, selectively inserting simultaneously a plurality of parallel weft yarns a predetermined distance into the sheds between the warp yarn layers;

in a first interweft insertion step, selectively positioning at least one group of binder yarns in a first position between parallel spaced yarns of the warp yarn layers, the first position corresponding to a first warp yarn layer and carrying out a weft insertion step whilst the group of binder yarns is at the first position; and a) in a second interweft insertion step, selectively moving the group of binder yarns relative to the warp yarn layers from the first position to a second position corresponding to a second warp yarn layer; carrying out a weft insertion step whilst the group of binder yarns is at the second position; in a third interweft insertion step, selectively moving the group of binder yarns relative to the warp yarn layers from the second position to a third position corresponding to a third warp yarn layer; and carrying out a weft insertion step whilst the group of binder yarns is at the third position, wherein at least one of the first, second and third position does not correspond to the top warp yarn layer or the bottom warp yarn layer; and/or b) in a single interweft insertion step, selectively moving the group of binder yarns through only some of the warp yarn layers, such that the transit of binder yarns from the top warp yarn layer to the bottom warp yarn layer, or from the bottom warp yarn layer to the top warp yarn layer, does not occur in a single interweft insertion step.

2. A method according to claim 1, wherein the group of binder yarns are moved in such a manner that they extend in the woven fabric progressively through multiple yarn layers, occupying different positions relative to the warp yarn layers between each weft insertion.

3. A method according to claim 1, wherein the group of binder yarns are moved between successive weft insertions such that the binder yarns extend in a direction in the woven fabric that is not orthogonal to the warp yarns.

4. A method according to claim 1, further comprising not moving the group of binder yarns between selected weft insertions such that they extend through the woven fabric in a series of orthogonal steps, without extending across all the layers of the warp yarns between successive insertions of weft yarns, optionally wherein the binder yarns extend in the woven fabric in a first direction that is orthogonal to the warp and weft yarns and, after one or more insertions of the weft yarns, extend in a second direction that is perpendicular to the first direction and parallel to the direction of the warp yarns.

5. A method according to claim 1, wherein there is more than one group of binder yarns, the groups being moved independently.

6. A method according to claim 1, further comprising threading the binder yarns of the at least one group through an eye in a respective heald wire, each heald wire having a plurality of vertically spaced eyes for receipt of yarns from different layers, each heald wire being movable in a direction along its length to move the binder yarns, optionally wherein the group of binder yarns is moveable in unison by a heald frame, the heald wires for the group being supported in the heald frame.

7. A method according to claim 1, further comprising threading the warp yarn through an eye in a respective heald wire, each heald wire having a plurality of vertically spaced eyes for receipt of yarns from different warp yarn layers.

8. A method according to claim 1 wherein at least one group of binder yarns is moved such that the binder yarns pass through substantially all the layers of warp yarn, such that for an integer n of warp yarn layers, the binder yarns move through up to n−1 warp yarn layers in a single interweft insertion step.

9. A method according to claim 1 wherein at least one group of binder yarns is moved such that the binder yarns pass through only a selected number of successive layers of warp yarn in a single interweft insertion step.

10. A method according to claim 1, further comprising selectively moving at least one warp yarn layer relative to the other warp yarn layers, when the warp yarn layers are separated, optionally further comprising selectively moving at least one warp yarn layer outwards of the other warp yarn layers so that they are removed from the woven fabric.

11. A loom for weaving a three-dimensional fabric comprising:

a shedding assembly comprising at least one support for providing a plurality of separated layers of warp yarns under tension, such that there is a top warp yarn layer corresponding to the top of the fabric, a bottom warp yarn layer corresponding to the bottom of the fabric, and at least one warp yarn layer interposed between the top and bottom warp yarn layer, each layer comprising a plurality of parallel spaced yarns, the separated the layers of warp yarns defining a shed between each layer;

a weft picking mechanism for, in a weft insertion step, selectively inserting simultaneously a plurality of parallel weft yarns a predetermined distance into the sheds between the warp yarn layers;

a binder yarn positioning mechanism for, in a first interweft insertion step, selectively positioning at least one group of binder yarns in a first position between parallel spaced yarns of the warp yarn layers, the first position corresponding to a first warp yarn layer, and carrying out a second weft insertion step whilst the group of binder yarns is at the first position; the binder yarn positioning mechanism being operable to a) in a second interweft insertion step, prior to a third weft insertion step, selectively move the group of binder yarns relative to the warp yarn layers from the first position to a second position corresponding to a second warp yarn layer; and in a third interweft insertion step, prior to a fourth weft insertion step, selectively move the group of binder yarns relative to the warp yarn layer from the second position to a third position corresponding to a third warp yarn layer, wherein at least one of the first, second and third position does not correspond to the top warp yarn layer or the bottom warp yarn layer; and/or b) in a single interweft insertion step, selectively move the group of binder yarns through only some warp yarn layers such that the transit of binder yarns from the top warp yarn layer to the bottom warp yarn layer, or from the bottom warp yarn layer to the top warp yarn layer, does not occur in a single interweft insertion step.

12. A loom according to claim 11, wherein the binder yarn positioning mechanism comprises a plurality of heald wires having heald eyes for receipt of a respective binder yarn, the heald wires being selectively movable between said more than two positions, and/or wherein the shedding assembly has at least two groups of supports, each for supporting at least one warp yarn layer, optionally wherein the supports are selectively moveable relative to one another, wherein the supports are optionally heald frames, each having at least one heald wire with at least one eye for supporting a warp yarn.

13. A loom according to claim 11, wherein the shedding assembly comprises a plurality of heald wires having vertically spaced heald eyes for receipt of warp yarns, such that the warp yarns are held apart to define sheds between them, optionally wherein there are at least two groups of heald wires in the shedding assembly, a first group for a first group of warp yarn layers and a second group for a second group of warp yarn layers, at least one of the first and second groups being movable relative to the other.

14. A component made from a composite material comprising a substrate in the form of three-dimensional woven fabric produced according to a method of claim 1, the substrate being impregnated with a polymer.

15. A loom according to claim 11, wherein the shedding assembly comprises at least one elongate yarn guide for providing a plurality of separated yarns under tension, the elongate yarn guide comprising first and a second end portions joined by an elongate central body portion, the elongate body portion comprising a plurality of apertures spaced along its longitudinal axis, each aperture being configured to receive at least one yarn under tension, optionally wherein the at least one elongate yarn guide is a heald wire comprising a plurality of apertures spaced along the longitudinal axis of the wire, each aperture configured to receive at least one yarn under tension.

* * * * *